US009123248B2

(12) United States Patent
Takahashi et al.

(10) Patent No.: US 9,123,248 B2
(45) Date of Patent: Sep. 1, 2015

(54) ALARM DEVICE

(75) Inventors: Yoshihiko Takahashi, Miyoshi (JP); Tetsuya Komoguchi, Nagakute-cho (JP); Tomoya Kawasaki, Miyoshi (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 1 day.

(21) Appl. No.: 14/343,578

(22) PCT Filed: Sep. 12, 2011

(86) PCT No.: PCT/JP2011/070765
§ 371 (c)(1),
(2), (4) Date: Mar. 7, 2014

(87) PCT Pub. No.: WO2013/038477
PCT Pub. Date: Mar. 21, 2013

(65) Prior Publication Data

US 2014/0225722 A1 Aug. 14, 2014

(51) Int. Cl.
*G08G 1/16* (2006.01)

(52) U.S. Cl.
CPC . *G08G 1/16* (2013.01); *G08G 1/168* (2013.01)

(58) Field of Classification Search
CPC ..... G08G 1/16
USPC ..... 340/932.2, 903, 904, 435; 701/301
See application file for complete search history.

(56) References Cited

U.S. PATENT DOCUMENTS

2002/0154007 A1* 10/2002 Yang ..... 340/456
2006/0164222 A1* 7/2006 Nou ..... 340/435
2006/0167594 A1* 7/2006 Mah ..... 701/1
2006/0250224 A1 11/2006 Steffel et al.
2006/0287828 A1 12/2006 Lehner
2010/0271237 A1 10/2010 Reed et al.
2014/0354450 A1* 12/2014 Takahashi et al. ..... 340/904

FOREIGN PATENT DOCUMENTS

| | | |
|---|---|---|
| JP | 2008 129974 | 6/2008 |
| JP | 2009 149249 | 7/2009 |
| WO | 2006 089624 | 8/2006 |

OTHER PUBLICATIONS

International Search Report Issued Oct. 18, 2011 in PCT/JP11/070765 Filed Sep. 12, 2011.

* cited by examiner

*Primary Examiner* — Brent Swarthout
(74) *Attorney, Agent, or Firm* — Oblon, McClelland, Maier & Neustadt, L.L.P.

(57) ABSTRACT

A control unit of an alarm device suppresses the activation of an alarm for a second another vehicle when a self-vehicle is reversing from a parked state, in a case where after one of a first detection unit, which is configured to detect another vehicle approaching from the back right of the self-vehicle, or the second detection unit, which is configured to detect another vehicle approaching from the back left of the self-vehicle, detects a first another vehicle, another one of the first detection unit or the second detection unit detects the second another vehicle, in a case where a distance difference between a first distance between the first another vehicle and the self-vehicle and a second distance between the second another vehicle and the self-vehicle is less than or equal to a predetermined distance, in a case where a speed difference between a first speed of the first another vehicle and a second speed of the second another vehicle is less than or equal to a predetermined speed, or in a case where a time difference between a first estimated crossing time of the first another vehicle and the self-vehicle and a second estimated crossing time of the second another vehicle and the self-vehicle is less than or equal to a predetermined time.

5 Claims, 13 Drawing Sheets

ALARM DEVICE

TECHNICAL FIELD

The present invention is related to an alarm device.

BACKGROUND ART

Conventionally, there is an alarm device for calculating the parking angle of a vehicle with respect to the travelling lane, based on a yaw rate detected by a yaw rate sensor installed in the vehicle or the rudder angle detected by a rudder angle sensor for detecting the steering angle, storing the calculated parking angle in a non-volatile memory, etc., and setting the angle of an alert area behind the self-vehicle when reversing the vehicle from the parked state (see, for example, Patent Document 1).

PRIOR ART DOCUMENT

Patent Document 1: U.S. Patent Application Publication No. 2010/0271237

SUMMARY OF INVENTION

Problem to be Solved by Invention

Incidentally, in a conventional alert device, when there is another vehicle parked adjacent to the self-vehicle, and when there is a wall of a building, etc., on the side of the self-vehicle, there are cases where one other vehicle that is approaching is detected as two other vehicles approaching from different directions, due to a multipath reflected from another vehicle or a wall.

That is to say, for example, when there is one other vehicle passing from the left side to the right side behind the self-vehicle, due to a multipath reflected from another vehicle or a wall adjacent to the self-vehicle, it is detected that there is one more another vehicle passing from the right side to the left side behind the self-vehicle. In this case, the other vehicle detected as passing from the right side to the left side behind the self-vehicle is a vehicle that does not actually exist, and is a ghost appearing due to erroneous detection.

In this case, a vehicle that does not actually exist is erroneously detected, and therefore degradation in the usability of the alarm device has been caused.

Accordingly, an objective is to provide an alarm device capable of suppressing erroneous detections.

Means to Solve the Problem

An alarm device according to an embodiment of the present invention includes a first detection unit configured to detect another vehicle approaching from the back right of a self-vehicle; a second detection unit configured to detect another vehicle approaching from the back left of the self-vehicle; an alarm unit configured to activate an alarm for notifying that another vehicle is approaching to a driver of the self-vehicle; and a control unit configured to cause the alarm unit to activate the alarm when the first detection unit or the second detection unit detects another vehicle, wherein the control unit suppresses the activation of the alarm for a second another vehicle when the self-vehicle is reversing from a parked state, in a case where after one of the first detection unit or the second detection unit detects a first another vehicle, another one of the first detection unit or the second detection unit detects the second another vehicle, in a case where a distance difference between a first distance between the first another vehicle and the self-vehicle and a second distance between the second another vehicle and the self-vehicle is less than or equal to a predetermined distance, in a case where a speed difference between a first speed of the first another vehicle and a second speed of the second another vehicle is less than or equal to a predetermined speed, or in a case where a time difference between a first estimated crossing time of the first another vehicle and the self-vehicle and a second estimated crossing time of the second another vehicle and the self-vehicle is less than or equal to a predetermined time.

Effects of the Invention

An alarm device capable of suppressing erroneous detections can be provided.

BEST MODE FOR CARRYING OUT THE INVENTION

In the following, a description is given of an embodiment to which an alarm device according to the present invention is applied.

First Embodiment

Figure 1:
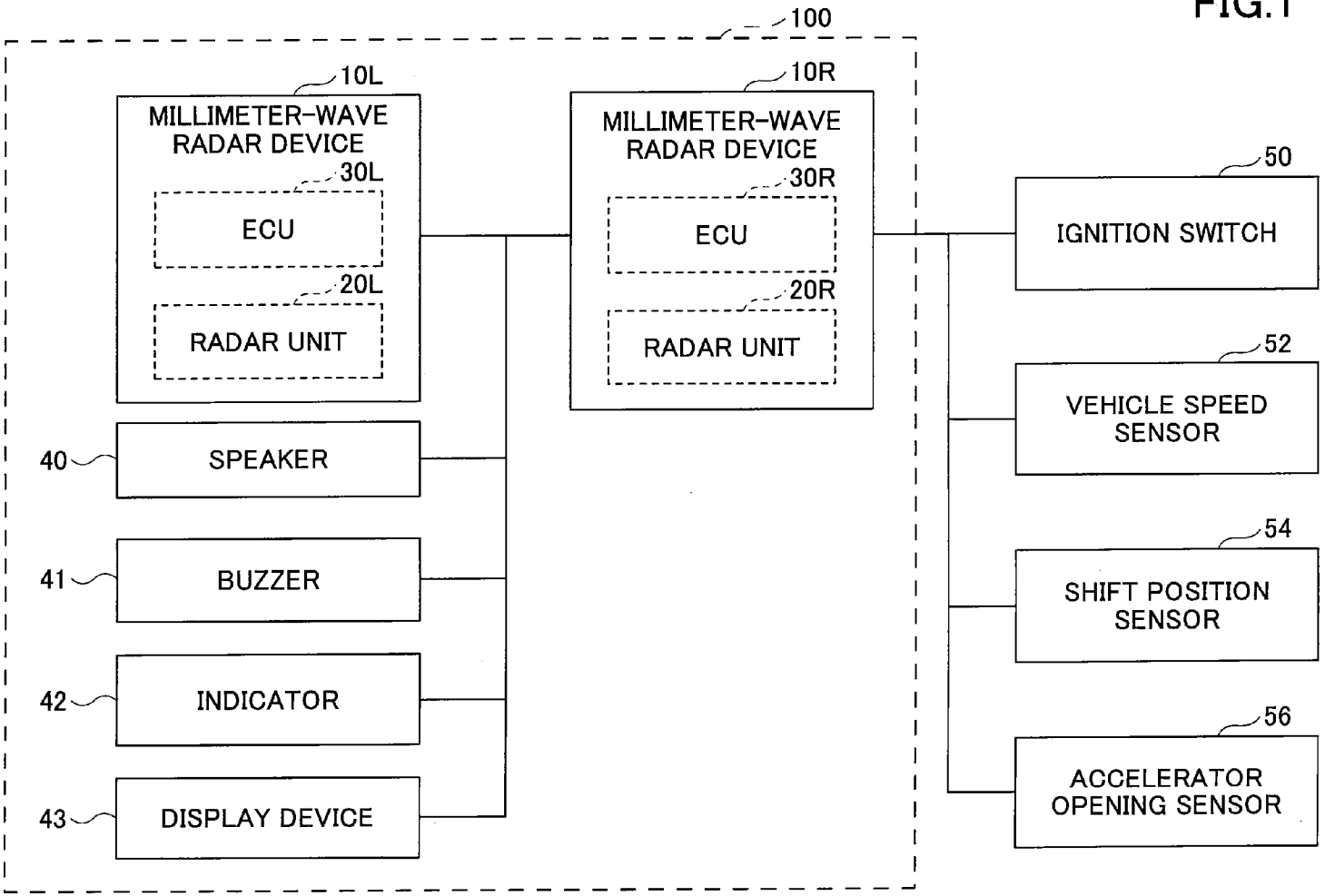
FIG. 1 is a block diagram indicating an alarm device 100 according to a first embodiment.

FIG. 1 is a block diagram indicating an alarm device 100 according to a first embodiment.

The alarm device 100 includes, as the main elements, millimeter-wave radar devices 10R, 10L, a speaker 40, a buzzer 41, an indicator 42, and a display device 43.

The millimeter-wave radar device 10R includes a radar unit 20R and an ECU (Electronic Control Unit) 30R. Furthermore, the millimeter-wave radar device 10L includes a radar unit 20L and an ECU 30L.

The millimeter-wave radar devices 10R, 10L are ECU-integrated type radar devices respectively including the radar units 20R, 20L and the ECUs 30R, 30L, and have the same configuration.

One of the ECU-integrated type millimeter-wave radar devices 10R, 10L functions as a master device and the other one functions as a local device according to the way of connecting a connection pin. The first embodiment is described as an embodiment in which the millimeter-wave radar device 10R is used as the master device, and the millimeter-wave radar device 10L is used as the local device.

FIG. 1 is described as an embodiment of using the millimeter-wave radar device 10R as the master device, and using the millimeter-wave radar device 10L as the local device; however, the millimeter-wave radar device 10L may be used as the master device, and the millimeter-wave radar device 10R may be used as the local device. In this case, in FIG. 1, the millimeter-wave radar device 10R and the millimeter-wave radar device 10L are switched, and the ECU 30L built in the millimeter-wave radar device 10L is to be used as the ECU for unifying the control of the entire alarm device 100.

In the first embodiment, the ECU 30R is an ECU for unifying the control of the entire alarm device 100, and is an example of a control unit of the alarm device 100 according to the first embodiment.

The ECU 30R of the millimeter-wave radar device 10R is connected to the ECU 30L, the buzzer 41, the indicator 42, the display device 43, an ignition switch 50, a vehicle speed sensor 52, a shift position sensor 54, and an accelerator opening sensor 56, by, for example, a CAN (Control Area Network).

Here, note that a description is given of an embodiment using the ECU-integrated type millimeter-wave radar devices 10R, 10L; however, the millimeter-wave radar devices 10R, 10L may be radar devices that do not include ECUs. In this case, an ECU may be used, to which the detection signals of the radar units 20R, 20L are input, and to which the buzzer 41, the indicator 42, the display device 43, the ignition switch 50, the vehicle speed sensor 52, the shift position sensor 54, and the accelerator opening sensor 56 are connected.

Figure 2:
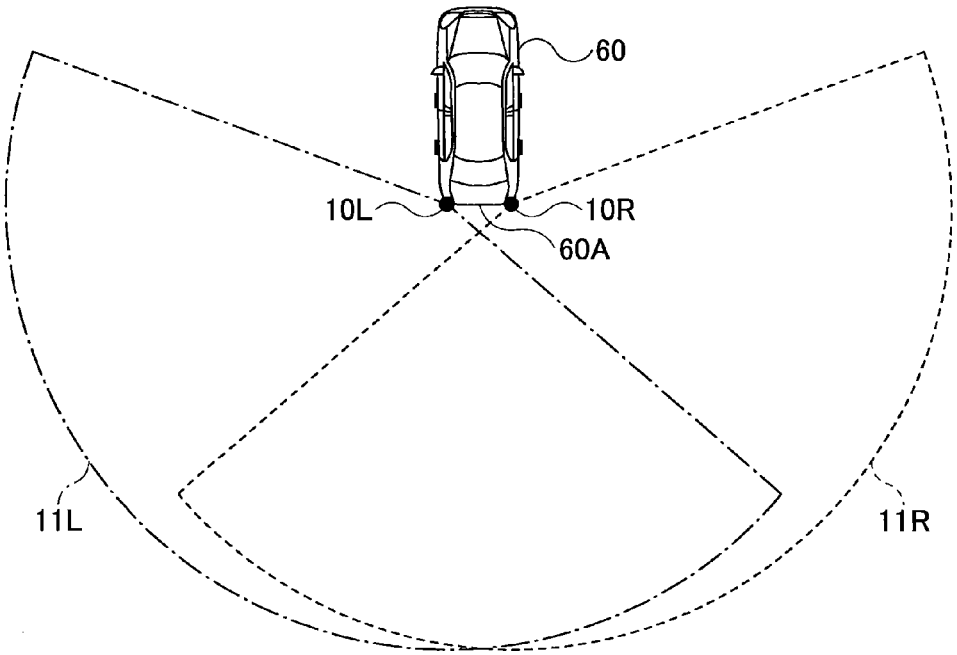
FIG. 2 is a diagram indicating the installation positions in a self-vehicle 60 of the millimeter-wave radar devices 10R, 10L included in the alarm device 100 according to the first embodiment, and detection possible regions 11R, 11L.

FIG. 2 is a diagram indicating the installation positions in a self-vehicle 60 of the millimeter-wave radar devices 10R, 10L included in the alarm device 100 according to the first embodiment, and detection possible regions 11R, 11L.

The millimeter-wave radar device 10R is attached to the right corner part of a back end part 60A of the self-vehicle 60. Furthermore, the millimeter-wave radar device 10L is attached to the left corner part of the back end part 60A of the self-vehicle 60. The millimeter-wave radar devices 10R, 10L are, for example, attached to the side member of a back part of the self-vehicle 60 or to the inside of a bumper of the back part of the self-vehicle 60.

Here, note that a description is given of a configuration in which the millimeter-wave radar devices 10R, 10L are respectively attached to the right corner part and the left corner part of the back end part 60A of the self-vehicle 60. However, the millimeter-wave radar devices 10R, 10L may be respectively attached to the back of the right side part and the back of the left side part of the self-vehicle 60, or to the right edge side of the back end part 60A and the left edge side of the back end part of the self-vehicle 60.

The millimeter-wave radar devices 10R, 10L respectively radiate electromagnetic waves to the back right and the back left of the vehicle by passing the electromagnetic waves through the bumper made of resin, etc., to detect reflected waves, and to detect the position, the movement direction, and the speed of another vehicle or an obstacle at the back right or the back left of the vehicle. The radar unit 20R is an example of a first detection unit for detecting another vehicle approaching from the back right of the vehicle by using radar, and the radar unit 20L is an example of a second detection unit for detecting another vehicle approaching from the back left of the vehicle by using radar.

The millimeter-wave radar devices 10R, 10L respectively have the detection possible regions 11R, 11L indicated in FIG. 2.

The detection possible region 11R indicated by dashed lines is a fan-shaped region having an angle of approximately 170° from the right side to the back, centering around the right corner part at the back part of the self-vehicle 60. The detection possible region 11L indicated by dashed-dotted lines is a fan-shaped region having an angle of approximately 170° from the left side to the back, centering around the left corner part at the back part of the self-vehicle 60.

The alarm device 100 may detect another vehicle in the entire regions of the detection possible regions 11R, 11L indicated in FIG. 2, or may detect another vehicle in part of the regions.

As for the calculation of the position, the movement direction, the speed, etc., by the millimeter-wave radar devices 10R, 10L, various techniques are already known; for example, the FM-CW (Frequency Modulated Continuous Wave) method and DBF (Digital Beam Forming) may be used for the calculation. In the following, this is briefly described.

First, the millimeter-wave radar devices 10R, 10L generate modulation signals obtained by modulating triangular waves, output transmission signals that are modulated so that the frequency increases and decreases according to the slope of the triangular waves, and generate beat signals obtained by mixing part of the transmission signals with reception signals.

The millimeter-wave radar devices 10R, 10L generate frequency spectrum data by performing a FFT (Fast Fourier Transform) process, etc., on the beat signals of each of the up sections and the down sections of a modulation cycle, and search the frequency spectrum data for a peak frequency in which the reception wave intensity forms a peak.

The millimeter-wave radar devices 10R, 10L obtain a distance D to an obstacle and a relative speed V, by formulas (1) through (6).

Assuming that fr is the frequency of the beat signals when the relative speed of the self-vehicle and the obstacle is zero, fd is the Doppler frequency based on the relative speed, fb1 is the beat frequency of the section (up section) where the frequency increases, and fb2 is the beat frequency of the section (down section) where the frequency decreases, the following formulas (1) and (2) are established.

Therefore, by separately measuring the beat frequencies fb1 and fb2 of the up section and the down section of the modulation cycle, fr and fd may be obtained by the following formulas (3) and (4). Then, when fr and fd are obtained, the distance D and the relative speed V of the self-vehicle 60 and the obstacle may be obtained by the following formulas (5) and (6).

Note that C is the speed of light, fm is the repetitive frequency of the triangular waves from which the transmission-use signals are generated, ΔF is the frequency shift width, and $f_0$ is the center frequency of the modulation wave.

$$fb1=fr-fd \quad (1)$$

$$fb2=fr+fd \quad (2)$$

$$fr=(fb1+fb2)/2 \quad (3)$$

$$fd=(fb1-fb2)/2 \quad (4)$$

$$D=(C/(4\cdot\Delta F\cdot fm))\cdot fr \quad (5)$$

$$V=(C/(2\cdot f_0))\cdot fd \quad (6)$$

Furthermore, the orientation of the obstacle may be calculated by DBF. When a radio wave approaching from a direction of an angle θ with respect to the direction of a center axis of the millimeter-wave radar devices 10R, 10L, is received with the use of an antenna array constituted by element antennas #1, #2, #3, . . . arranged at intervals d, the length of the propagation path of the radio wave at the element antenna #2 becomes longer by d sin θ than the length of the propagation path of the radio wave at the element antenna #1.

Therefore, the phase of the radio wave received by the element antenna #2 is delayed by (2πd sin θ)/λ with respect to the phase of the radio wave received by the element antenna #1. λ is the wave length of the radio wave. Assuming that this delay is corrected by a phase shifter, the radio waves from the θ direction are received by the same shift at both element antennas, and the directivity is directed to the θ direction.

DBF is a technology of converting the phase and the amplitude based on the above principle and combining the reception waves of the respective antenna elements, to form the directivity of the antenna. Accordingly, the millimeter-wave radar devices 10R, 10L may obtain the orientation θ of the obstacle.

When the distance D, the relative speed V, and the orientation θ are calculated as described above, the millimeter-wave radar devices 10R, 10L can calculate the position of the obstacle by using a predetermined position of the self-vehicle as a reference, the movement of the obstacle by using the center axis (i.e., the travelling direction) of the self-vehicle as a reference, and the movement speed of the obstacle.

As for the movement direction, the difference in the relative positions in a minute period may be obtained, and a speed vector may be obtained by using the relative speed V, the orientation angle θ, and the speed of the self-device as parameters.

Furthermore, the millimeter-wave radar devices 10R, 10L extract a vehicle from the obstacles by screening (sieving) the obstacles for which the position, the movement direction, the speed, etc., have been calculated as described above, by using the reception wave intensity, the estimated size, the speed, etc., as conditions of the screening.

Accordingly, the millimeter-wave radar devices 10R, 10L can obtain the position of another vehicle at the back right and the back left of the self-vehicle, the movement direction of the other vehicle by using as a reference the center axis of the self-vehicle, and the speed, etc., of another vehicle. In the following, a description is given of the present embodiment based on the assumption of the above technology.

Note that as a means for acquiring information of the position, the speed, etc., of another vehicle, a laser radar device, a quasi-millimeter-wave radar device, etc., may be used, instead of the millimeter-wave radar devices 10R, 10L. Furthermore, the calculation of the position, the speed, etc. of another vehicle may be performed by a method without using the Doppler effect.

The speaker 40, the buzzer 41, the indicator 42, and the display device 43 indicated in FIG. 1 are an example of an alarm unit for activating an alarm.

The speaker 40 is a speaker disposed in the interior of the self-vehicle, and outputs an alarm sound. For example, the speaker 40 may also act as a speaker for outputting the sound of audio equipment and a navigation device; a speaker that is exclusively used for generating an alarm sound of the alarm device 100 according to the first embodiment may be used as the speaker 40.

The indicator 42 is attached to an inner mirror, an outer mirror, a combination meter, etc., and performs lighting and blinking when activating an alarm. The display device 43 is, for example, a display unit of a navigation device, and performs lighting, blinking, etc., of the icon when activating an alarm. The indicator 42 or the display device 43 may have a configuration that makes it possible to indicate either the left or right direction with an arrow, etc., so that when another vehicle is detected, the driver may recognize the approaching direction of the other vehicle.

The ECU 30R is, for example, a computer unit in which a ROM, a RAM, etc., are interconnected via a bus centering around a CPU, and also includes storage devices including a HDD (Hard Disk Drive), an EEPROM (Electrically Erasable and Programmable Read Only Memory), etc., and an I/O port, a timer, a counter, etc.

Furthermore, signals are input to the ECU 30R, such as output signals of various switches/sensors including the ignition switch 50, the vehicle speed sensor 52, the shift position sensor 54, the accelerator opening sensor 56, etc., or state signals, etc., output by another ECU performing vehicle control using these switches/sensors.

The ECU 30R operates the millimeter-wave radar devices 10R, 10L when the self-vehicle reverses from a parked state, and when another vehicle detected by the millimeter-wave radar devices 10R, 10L is in a detection region at the back right side and the back left side of the vehicle, the ECU 30R activates an alarm sound from the speaker 40 and executes an alarm display indicating that another vehicle is approaching, with the buzzer 41, the indicator 42, and the display device 43.

The determination of whether the self-vehicle is in a "parked state" is made by setting a condition, such as an ACC off signal is input from the ignition switch 50, and a signal input from the shift position sensor 54 is indicating "P" (parking). Note that in this case, a condition may be added that the vehicle speed signal input from the vehicle speed sensor 52 immediately before turning off the ignition switch 50, is zero.

The determination of whether the self-vehicle is "reversing" can be made by setting a condition, such as after the above "parked state" period, the signal input from the shift position sensor 54 is indicating "R" (reverse).

Note that these condition settings are not limited to the above contents; some of the conditions may be removed, or other conditions may be added.

Figure 3:
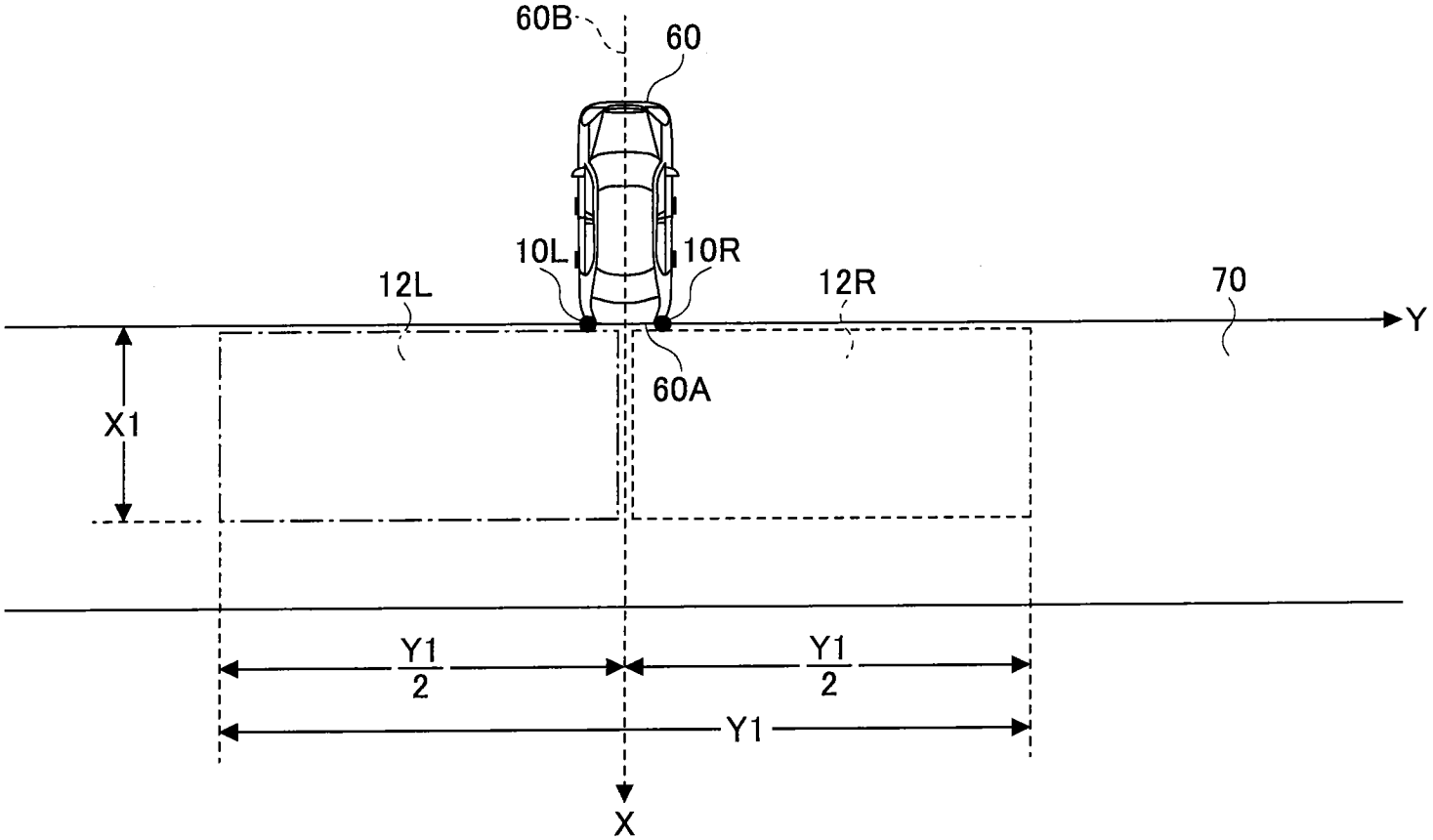
FIG. 3 indicates an example of detection regions 12R, 12L set by the ECU 30R when the self-vehicle 60 reverses from a state of being parked at a right angle with respect to the travelling lane.

FIG. 3 indicates an example of detection regions 12R, 12L set by the ECU 30R when the self-vehicle 60 reverses from a state of being parked at a right angle with respect to the travelling lane. The detection regions 12R, 12L are regions used when the alarm device 100 detects another vehicle, in the detection possible regions 11R, 11L indicated in FIG. 2, and the detection regions 12R, 12L are set by the ECU 30R. In FIG. 3, the detection region 12R is indicated by dashed lines, and the detection region 12L is indicated by dashed-dotted lines.

Here, on a center axis 60B of the self-vehicle 60, an X axis is defined, on which the backward direction of the self-vehicle is the positive direction, and a Y axis is defined, which is orthogonal to the X axis at the back end part 60A of the self-vehicle 60. The positive direction of the Y axis is assumed to be toward the right side as viewed in FIG. 3. The boundary between the detection region 12R and the detection region 12L is assumed to be on the center axis 60B.

As indicated in FIG. 3, in a state where the self-vehicle 60 is parked at a position where self-vehicle 60 has moved forward in the −X direction at a right angle with respect to a travelling lane 70, and the self-vehicle 60 starts reversing in the +X direction, a region, which is formed by combining the detection regions 12R, 12L, has a width X1 in the positive direction of the X axis from the back end part 60A of the self-vehicle 60 and widths Y1 extending to the left and right from the center axis 60B. In this region, the detection region 12R is a region having a width Y1/2 on the right side of the center axis 60B, and the detection region 12L is a region having a width Y1/2 on the left side of the center axis 60B.

The detection region 12R is a region on the back right of the self-vehicle 60 detected by the millimeter-wave radar device 10R that is the first detection unit. The detection region 12L is a region on the back left of the self-vehicle 60 detected by the millimeter-wave radar device 10L that is the second detection unit.

Note that the travelling lane 70 may be, for example, a travelling lane in the parking lot of a store, etc., or a road.

Figure 4A:
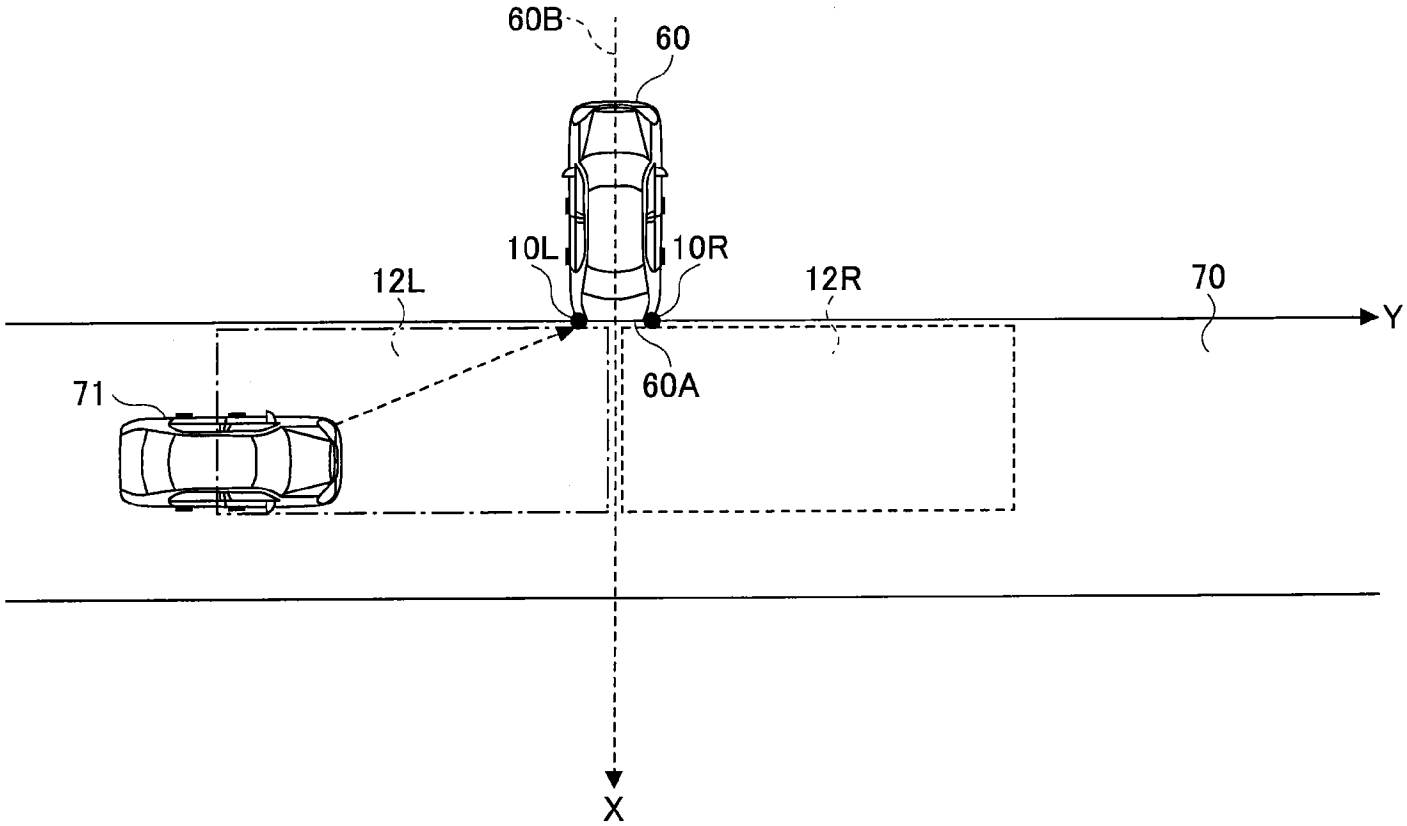
FIG. 4A is, a diagram indicating a state of detecting another vehicle 71 approaching from the left side, behind the self-vehicle 60 in which the alarm device according to a comparative example is installed.
Figure 4B:
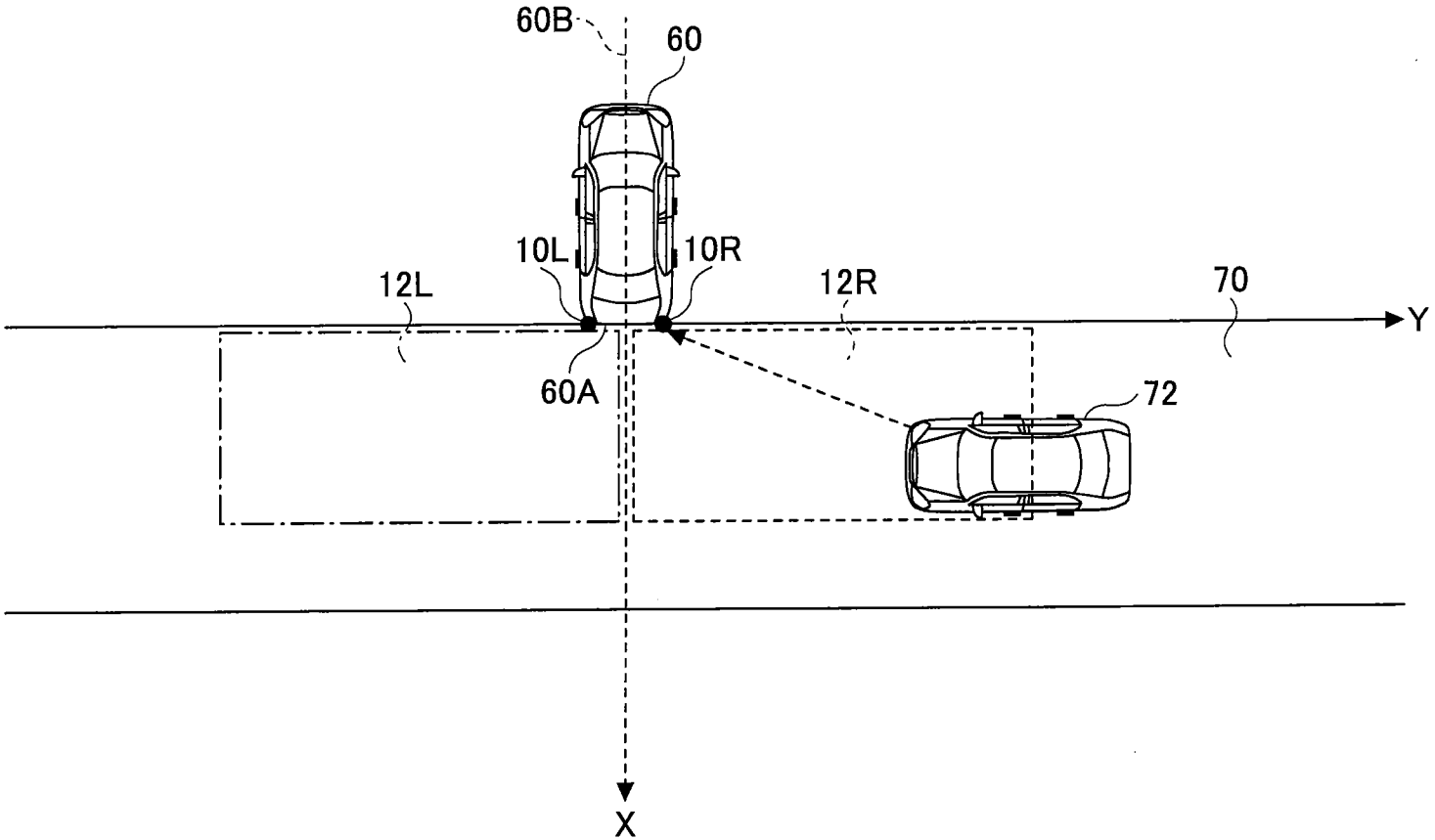
FIG. 4B is a diagram of detecting another vehicle 72 approaching from the right side, behind the self-vehicle 60 in which the alarm device according to the comparative example is installed.
Figure 5:
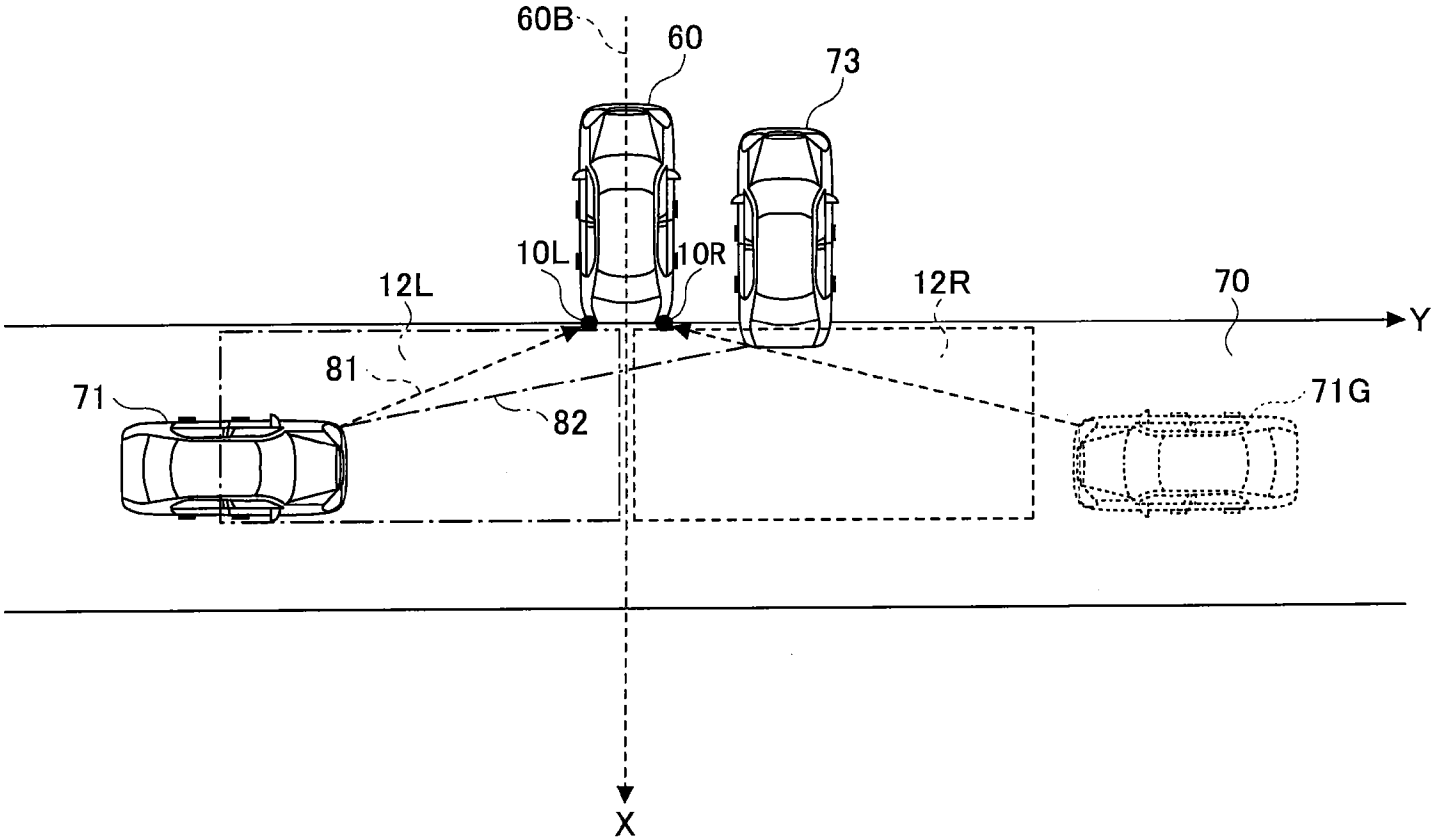
FIG. 5 is a diagram indicating a state where another vehicle 71 is approaching from the back left side, in a state where another vehicle 73 is parked on the immediate right of the self-vehicle 60, in which the alarm device according to the comparative example is installed.

Next, before describing the ECU 30R of the alarm device 100 according to the first embodiment, with reference to FIGS. 4A, 4B, and 5, a description is given of detecting another vehicle behind the self-vehicle 60 by an alarm device according to a comparative example. A description is given on the assumption that in the self-vehicle 60 of FIGS. 4A, 4B, and 5, an alarm device according to the comparative example is installed.

The alarm device according to the comparative example has the same configuration as the alarm device 100 according to the first embodiment indicated in FIG. 1; however, unlike the alarm device 100 according to the first embodiment, a problem indicated in FIG. 5 arises.

FIG. 4A is a diagram indicating a state of detecting another vehicle 71 approaching from the left side, behind the self-vehicle 60 in which the alarm device according to the comparative example is installed. FIG. 4B is a diagram of detecting another vehicle 72 approaching from the right side, behind the self-vehicle 60 in which the alarm device according to the comparative example is installed. FIG. 5 is a diagram indicating a state where another vehicle 71 is approaching from the back left side, in a state where another vehicle 73 is parked on the immediate right of the self-vehicle 60, in which the alarm device according to the comparative example is installed.

As indicated in FIG. 4A, behind the self-vehicle 60 in which the alarm device according to the comparative example is installed, when another vehicle 71 approaching from the left side enters the detection region 12L, by receiving a reflected wave from another vehicle 71 by the millimeter-wave radar device 10L, the alarm device according to the comparative example detects another vehicle 71 approaching from the left side behind the self-vehicle 60. As a result, to the driver of the self-vehicle 60 in which the alarm device according to the comparative example is installed, an alarm is notified, indicating that another vehicle 71 is approaching from the left side behind the self-vehicle 60, through the speaker 40, the buzzer 41, the indicator 42, and the display device 43.

Furthermore, as indicated in FIG. 4B, behind the self-vehicle 60 in which the alarm device according to the comparative example is installed, when another vehicle 72 approaching from the right side enters the detection region 12R, by receiving a reflected wave from another vehicle 72 by the millimeter-wave radar device 10R, the alarm device according to the comparative example detects another vehicle 72 approaching from the right side behind the self-vehicle 60. As a result, to the driver of the self-vehicle 60 in which the alarm device according to the comparative example is installed, an alarm is notified, indicating that another vehicle 72 is approaching from the right side behind the self-vehicle 60, through the speaker 40, the buzzer 41, the indicator 42, and the display device 43.

Furthermore, in FIG. 5, another vehicle 73 is parked in a parking space on the immediate right of the parking space where the self-vehicle 60 in which the alarm device according to the comparative example is installed is parked, and another vehicle 71 is approaching from the left side behind the self-vehicle 60. In this case, when another vehicle 71 enters the detection region 12L, a reflected wave 81 reflected by another vehicle 71 is received by the millimeter-wave radar device 10L along a path indicated by a dashed line, and a reflected wave 82 reflected by another vehicle 71 is reflected by the left surface of another vehicle 73 along a path indicated by a dashed-dotted line and received by the millimeter-wave radar device 10R. The path of the reflected wave 82 indicated by the dashed-dotted line is a multipath with respect to the path of the reflected wave 81 which is the proper path.

As a result, the alarm device according to the comparative example detects that another vehicle 71 is approaching from the left side behind the self-vehicle 60, and then also immediately detects that another vehicle 71G is approaching from the right side behind the self-vehicle 60.

In this case, another vehicle 71G is a ghost generated as the reflected wave 82, which is reflected by another vehicle 71, is reflected by the left side surface of another vehicle 73 parked on the immediate right of the self-vehicle 60, and another vehicle 71G is erroneously detected as a vehicle that does not actually exist.

The detection of a ghost as described above may similarly occur in a case where another vehicle 73 is parked on the right side of the self-vehicle 60, spaced away from the self-vehicle 60 by one or a plurality of parking spaces. Furthermore, the detection of a ghost may also similarly occur in a case where another vehicle 73 is parked in the parking space on the left side of the self-vehicle 60. Furthermore, the detection of a ghost may also similarly occur in a case where there is a wall of a building, etc., on the right side or the left side of the self-vehicle 60.

As described above, the alarm device according to the comparative example has a problem of erroneously detecting a ghost, when another vehicle 73 is parked or there is a wall of a building, on the right side or the left side of the self-vehicle 60, and a multipath may be generated.

On the other hand, by the alarm device 100 according to the first embodiment described below, detection of another vehicle 71G which is a ghost as indicated in FIG. 5 is suppressed, and the usability is improved.

Figure 6A:
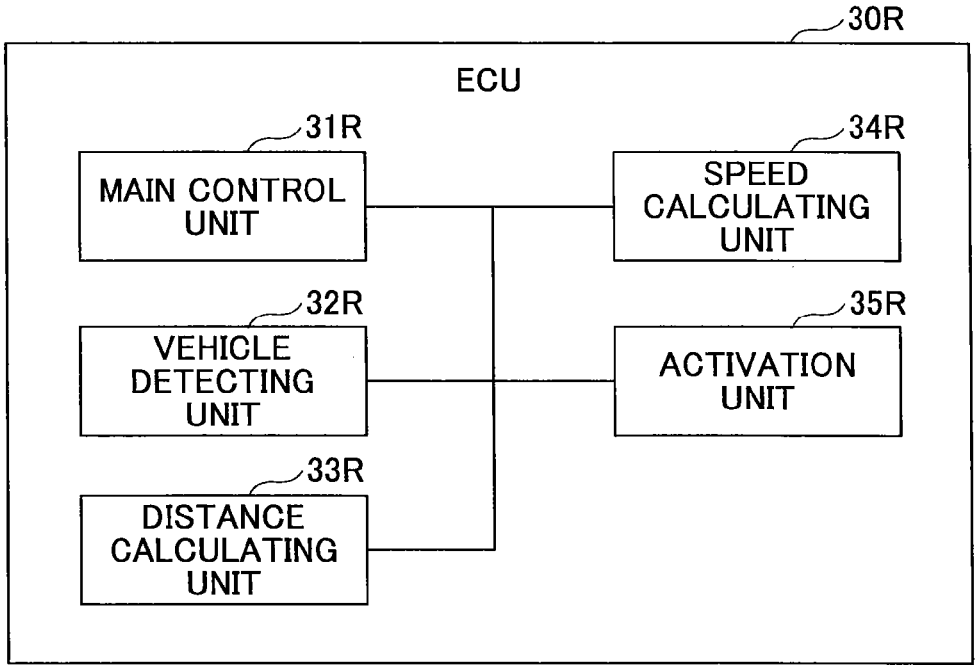
FIG. 6A is a diagram indicating functional blocks included in the ECU 30R of the alarm device 100 according to the first embodiment.
Figure 6B:
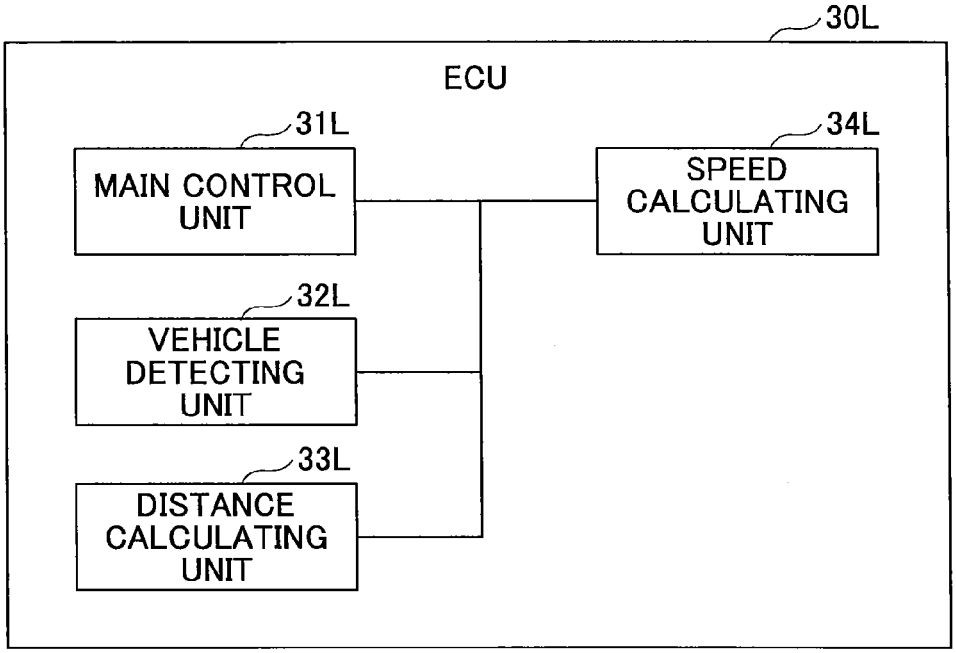
FIG. 6B is a diagram indicating functional blocks included in the ECU 30L of the alarm device 100 according to the first embodiment.

FIG. 6A is a diagram indicating functional blocks included in the ECU 30R of the alarm device 100 according to the first embodiment. FIG. 6B is a diagram indicating functional blocks included in the ECU 30L of the alarm device 100 according to the first embodiment.

The ECU 30R includes a main control unit 31R, a vehicle detecting unit 32R, a distance calculating unit 33R, a speed calculating unit 34R, and an activation unit 35R. Furthermore, the ECU 30L includes a main control unit 31L, a vehicle detecting unit 32L, a distance calculating unit 33L, a speed calculating unit 34L, and an activation unit 35L.

The main control unit 31R is a processing unit that unifies internal processes of the ECU 30R, and performs a determination process described below.

The vehicle detecting unit 32R detects whether there is another vehicle and detects the orientation of another vehicle with respect to the self-vehicle, based on signals input from the radar unit 20R. The determination of whether there is another vehicle is performed by determining a moving object as another vehicle, among the obstacles detected by signals input from the radar unit 20R. Furthermore, the orientation (θ) of another vehicle may be calculated by DBF as described above.

The distance calculating unit 33R calculates the distance between the self-vehicle 60 and another vehicle, based on signals input from the radar unit 20R. The distance D between the self-vehicle 60 and another vehicle is derived by formula (5) described above.

The speed calculating unit 34R calculates the relative speed of the self-vehicle and another vehicle, the movement direction, and the speed vector of another vehicle, based on signals input from the radar unit 20R. The relative speed V of the self-vehicle and another vehicle is derived by formula (6) described above. Furthermore, the speed calculating unit 34R obtains the movement direction of another vehicle from the difference in the relative positions in a minute period.

The activation unit 35R activates an alarm for the speaker 40, the buzzer 41, the indicator 42, and the display device 43, when the main control unit 31R determines that an alarm needs to be activated.

The main control unit 31L unifies internal processes of the ECU 30L, and transmits, to the main control unit 31R of the ECU 30R, whether there is another vehicle detected by the vehicle detecting unit 32R and the orientation of another vehicle, a distance D calculated by the distance calculating unit 33R, the relative speed detected by the speed calculating unit 34R, the movement direction, and the speed vector.

The vehicle detecting unit 32L detects whether there is another vehicle and detects the orientation of another vehicle with respect to the self-vehicle, based on signals input from the radar unit 20L. The determination of whether there is another vehicle is performed by determining a moving object as another vehicle, among the obstacles detected by signals input from the radar unit 20L. Furthermore, the orientation (θ) of another vehicle may be calculated by DBF as described above.

The distance calculating unit 33L calculates the distance between the self-vehicle 60 and another vehicle, based on signals input from the radar unit 20L. The distance D between the self-vehicle 60 and another vehicle is derived by formula (5) described above.

The speed calculating unit 34L calculates the relative speed of the self-vehicle and another vehicle, the movement direction, and the speed vector of another vehicle, based on signals input from the radar unit 20L. The relative speed V of the self-vehicle and another vehicle is derived by formula (6) described above. Furthermore, the speed calculating unit 34L obtains the movement direction of another vehicle from the difference in the relative positions in a minute period.

After one of the millimeter-wave radar devices 10R, 10L detects a first another vehicle approaching the self-vehicle 60, the main control unit 31R determines whether a second another vehicle is detected by the other one of the millimeter-wave radar devices 10R, 10L. For example, after a first another vehicle approaching from the back right of the self-vehicle 60 is detected by the millimeter-wave radar device 10R, the main control unit 31R determines whether a second another vehicle approaching from the back left of the self-vehicle 60 is detected by the millimeter-wave radar device 10L. The main control unit 31R determines whether the second another vehicle approaching from the back left of the self-vehicle 60 is detected, based on information transmitted from the main control unit 31L in the ECU 30L of the millimeter-wave radar device 10L.

Furthermore, by contrast, after a first another vehicle approaching from the back left of the self-vehicle 60 is detected by the millimeter-wave radar device 10L, the main control unit 31R determines whether a second another vehicle approaching from the back right of the self-vehicle 60 is detected by the millimeter-wave radar device 10R.

Furthermore, after one of the millimeter-wave radar devices 10R, 10L detects a first another vehicle approaching the self-vehicle 60, when a second another vehicle is detected by the other one of the millimeter-wave radar devices 10R, 10L, the main control unit 31R determines whether a second distance between the second another vehicle and the self-vehicle 60 is longer than a first distance between the first another vehicle and the self-vehicle 60, and the distance difference between the first distance and the second distance is less than or equal to a predetermined distance.

Here, the information indicating the distance between another vehicle and the self-vehicle 60 calculated by the millimeter-wave radar device 10L, is transmitted from the main control unit 31L to the main control unit 31R.

The predetermined distance is set to, for example, 5 m. This predetermined distance is determined based on the path difference between the reflected wave 81 and the reflected wave 82 indicated in FIG. 5. The path of the reflected wave 82 is set based on a value obtained by adding together the vehicle width of one vehicle and two times the interval between adjacent vehicles, in comparison to the reflected wave 81. The predetermined distance is set in this manner to determine whether there is another vehicle 71G that is a ghost, as indicated in FIG. 5.

Furthermore, when the main control unit 31R determines that the second distance is longer than the first distance as described above, and the distance difference between the first distance and the second distance is less than or equal to a predetermined distance, the main control unit 31R determines whether the speed difference between the relative speed of the first another vehicle and the self-vehicle, and the relative speed of the second another vehicle and the self-vehicle, is less than or equal to a predetermined speed.

Here, the information indicating the relative speed of another vehicle and the self-vehicle 60 calculated by the millimeter-wave radar device 10L is transmitted from the main control unit 31L to the main control unit 31R.

The relative speed of another vehicle 71G that is a ghost indicated in FIG. 5 and the self-vehicle 60, and the relative speed of another vehicle 71 and the self-vehicle 60, are considered to be substantially the same. The another vehicle 71 that actually exists, and another vehicle 71G that is a ghost, are detected by separate millimeter-wave radar devices 10R, 10L that are installed at different positions in the self-vehicle 60, and the relative speed does not always match.

Therefore, by determining whether the speed difference between the relative speed of one another vehicle and the self-vehicle, and the relative speed of the other another vehicle and the self-vehicle, is less than or equal to a predetermined speed, it is determined whether the vehicle is another vehicle 71G that is a ghost.

Furthermore, when the main control unit 31R determines that the speed difference between the relative speed of the first another vehicle and the self-vehicle, and the relative sped of the second another vehicle and the self-vehicle, is less than or equal to a predetermined speed as described above, the main control unit 31R masks the activation of the alarm for the second another vehicle. Masking the activation of the alarm means to prevent the main control unit 31R from transmitting the activation of the alarm to the activation unit 35R, when the main control unit 31R or 31L determines that an alarm needs to be activated for the second another vehicle. Note that to mask the activation of an alarm is an example of suppressing the activation of an alarm.

Specifically, when the first another vehicle is detected by the millimeter-wave radar device 10R, and the second another vehicle is detected by the millimeter-wave radar device 10L, the main control unit 31R causes the activation unit 35R to perform the activation of the alarm for the first another vehicle detected by the millimeter-wave radar device 10R, and does not cause the activation unit 35R to perform the activation of the alarm for the second another vehicle detected by the millimeter-wave radar device 10L to mask the activation of the alarm.

Conversely, when the first another vehicle is detected by the millimeter-wave radar device 10L, and the second another vehicle is detected by the millimeter-wave radar device 10R, the main control unit 31R causes the activation unit 35R to perform the activation of the alarm for the first another vehicle detected by the millimeter-wave radar device 10L, and does not cause the activation unit 35R to perform the activation of the alarm for the second another vehicle detected by the millimeter-wave radar device 10R, to mask the activation of the alarm.

As described above, for the second another vehicle that is detected, the activation of the alarm is not performed. That is to say, the activation of the alarm is masked for the second another vehicle that is detected.

Figure 7:
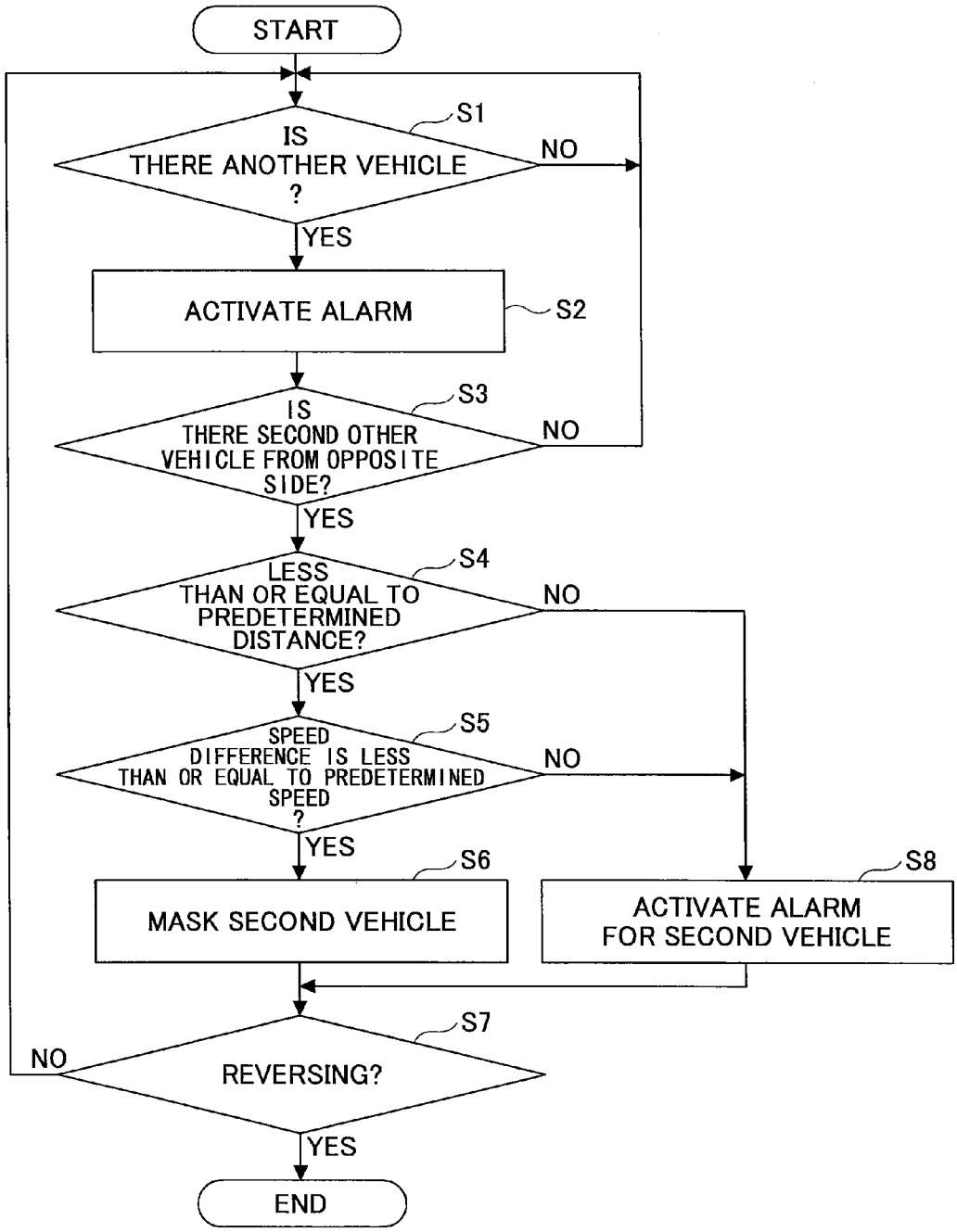
FIG. 7 is a flowchart indicating a process executed by the ECU 30R of the alarm device 100 according to the first embodiment.

Next, with reference to FIG. 7, a description is given of a determination process performed by the ECU 30R of the alarm device 100 according to the first embodiment.

FIG. 7 is a flowchart indicating a process executed by the ECU 30R of the alarm device 100 according to the first embodiment. The process according to this flowchart is a process executed by the main control unit 31R of the ECU 30R of the alarm device 100 according to the first embodiment.

When the self-vehicle 60 starts reversing from a parked state, the main control unit 31R starts the process (START). As the signal input from the shift position sensor 54 indicates "R" (reverse), the main control unit 31R recognizes that the self-vehicle 60 has started reversing from the parked state.

The main control unit 31R determines whether another vehicle is detected (step S1). The detection of another vehicle is to be performed based on whether a detection signal has been received from the radar unit 20R or 20L.

When the main control unit 31R determines that another vehicle has been detected (step S1: YES), the main control unit 31R transmits the activation instruction to the activation unit 35R (step S2). As a result, the activation unit 35R causes the speaker 40, the buzzer 41, the indicator 42, and the display device 43 to activate an alarm.

Note that the activation instruction is an instruction for activating an alarm that another vehicle is approaching from the back right, when the main control unit 31R has received a detection signal from the radar unit 20R, and the activation instruction is an instruction for activating an alarm that another vehicle is approaching from the back left, when the main control unit 31R has received a detection signal from the radar unit 20L.

Next, the main control unit 31R determines whether the second another vehicle is detected from the other one of the millimeter-wave radar devices 10R, 10L (step S3). That is to say, in step S3, the main control unit 31R determines whether the second another vehicle has been detected on the opposite (left or right) side to another vehicle detected in step S1.

This is because a ghost may be erroneously detected as a second another vehicle, in a case where a second another vehicle, which is approaching from the opposite side that is different from the movement direction of the first another vehicle, is detected after the first another vehicle approaching from the back right side or the back left side of the self-vehicle 60 is detected.

When the main control unit 31R determines that a second another vehicle is detected (step S3: YES), the main control unit 31R determines whether a second distance between the second another vehicle and the self-vehicle 60 is longer than a first distance between the first another vehicle and the self-vehicle 60, and the distance difference between the first distance and the second distance is less than or equal to a predetermined distance (step S4).

The millimeter-wave radar devices 10R, 10L calculate the distance between the self-vehicle 60 and another vehicle by the distance calculating units 33R, 33L, respectively. Among the distances calculated by the distance calculating units 33R, 33L, the distance calculated with respect to the first another vehicle is the first distance, and the distance calculated with respect to the second another vehicle is the second distance.

Accordingly, the main control unit 31R compares the first distance and the second distance calculated by the distance calculating units 33R, 33L, to determine whether the second distance is longer than the first distance, and the distance difference between the first distance and the second distance is less than or equal to a predetermined distance. Note that the predetermined distance is, for example, 5 m, as described above.

When the main control unit 31R determines that the second distance is longer than the first distance, and the distance difference between the first distance and the second distance is less than or equal to a predetermined distance (step S4: YES), the main control unit 31R determines whether the speed difference between the relative speed of the first another vehicle and the self-vehicle and the relative speed of the second another vehicle and the self-vehicle is less than or equal to a predetermined speed (step S5).

The millimeter-wave radar devices 10R, 10L calculate the relative speed of the self-vehicle 60 and another vehicle by the speed calculating units 34R, 34L, respectively. Among the relative speeds calculated by the speed calculating units 34R, 34L, the relative speed calculated with respect to the first another vehicle is a first relative speed, and the relative speed calculated with respect to the second another vehicle is a second relative speed.

Therefore, the main control unit 31R compares the first relative speed and the second relative speed calculated by the speed calculating units 34R, 34L, to determine whether the speed difference between the first relative speed and the second relative speed is less than or equal to a predetermined speed.

When the main control unit 31R determines that the speed difference between the first relative speed and the second relative speed is less than or equal to a predetermined speed (step S5: YES), the main control unit 31R masks the activation of the alarm with respect to vehicle detected as the second another vehicle (step S6).

Accordingly, the activation of the alarm with respect to the vehicle detected as the second another vehicle is masked. This is because the second another vehicle has been determined to be a ghost.

Next, the main control unit 31R determines whether the self-vehicle 60 is reversing (step S7). When the self-vehicle 60 is reversing, other vehicles need to be continuously detected, and when the self-vehicle 60 is not reversing, other vehicles do not need to be continuously detected, and therefore it is determined whether the self-vehicle 60 is reversing.

The main control unit 31R determines whether the self-vehicle 60 is reversing, based on whether the signal input from the shift position sensor 54 is indicating "R" (reverse). Note that reversing mentioned here means a state where the shift position is in "R" (reverse), and does not mean whether the self-vehicle 60 is actually moving backwards.

When the main control unit 31R determines that the self-vehicle 60 is reversing (step S7: YES), the main control unit 31R returns to step S1 in the flow, and the main control unit 31R executes the process of step S1. Furthermore, when the main control unit 31R determines that the self-vehicle 60 is not reversing (step S7: NO), the series of process are ended. This is because, for example, when the self-vehicle 60 starts moving forward, there is no need to monitor another vehicle behind the self-vehicle 60.

Note that in step S3, when the main control unit 31R determines that a second another vehicle is not detected, the main control unit 31R returns to step S1 in the flow. In this case, there is no possibility that a ghost is erroneously detected, and therefore the main control unit 31R returns to step S1 in the flow.

Furthermore, in step S4, when the main control unit 31R determines that a second distance between the second another vehicle and the self-vehicle 60 is not longer than a first distance between the first another vehicle and the self-vehicle 60, or the distance difference between the first distance and the second distance is not less than or equal to a predetermined distance, the main control unit 31R proceeds to step S8 in the flow.

The main control unit 31R transmits an activation instruction to the activation unit 35R, to activate an alarm with respect to the second another vehicle (step S8). As a result, the activation unit 35R causes the speaker 40, the buzzer 41, the indicator 42, and the display device 43 to activate an alarm. This alarm is an alarm with respect to the second another vehicle.

When the second distance is not longer than the first distance, and when the distance difference between the first distance and the second distance is not less than or equal to the predetermined distance, there is a high possibility that the second another vehicle is not a ghost, and therefore an alarm is also activated for the second another vehicle.

Note that when the process of step S8 ends, the main control unit 31R proceeds to step S7 in the flow.

Furthermore, in step S5, when the main control unit 31R determines that the speed difference between the first relative speed of the first another vehicle and the self-vehicle and the second relative speed of the second another vehicle and the self-vehicle is not less than or equal to a predetermined speed, the main control unit 31R proceeds to step S8 in the flow.

When the speed difference between the first relative speed and the second relative speed is not less than or equal to a predetermined speed, there is a high possibility that the second another vehicle is not a ghost, and therefore an alarm is also activated for the second another vehicle.

According to the above, the series of processes are ended.

Note that in addition to the process indicated in FIG. 7, it may be determined whether the movement directions of the two another vehicles having different movement directions are substantially symmetrical across the center axis 60B of the self-vehicle 60. This process can be realized by determining whether the directions of the speed vectors of the two another vehicles are substantially symmetrical across the center axis 60B of the self-vehicle 60. Furthermore, this process can be, for example, inserted between step S5 and step S6.

The speed vectors are respectively calculated by the speed calculating units 34R, 34R, and information expressing the calculated speed vectors is to be transmitted to the main control unit 31R.

For example, as indicated in FIG. 5, the movement direction of another vehicle 71 and the movement direction of another vehicle 71G that is a ghost are both detected as a direction that is approximately 90° with respect to the center axis 60B of the self-vehicle 60. This is because another vehicle 73 parked adjacent to the self-vehicle 60 is substantially parallel to the self-vehicle 60, and therefore the another vehicle 71G that is a ghost appears to have a movement direction that is substantially axisymmetrical with respect to the movement direction of another vehicle 71 across the center axis 60B of the self-vehicle 60.

Figure 8:
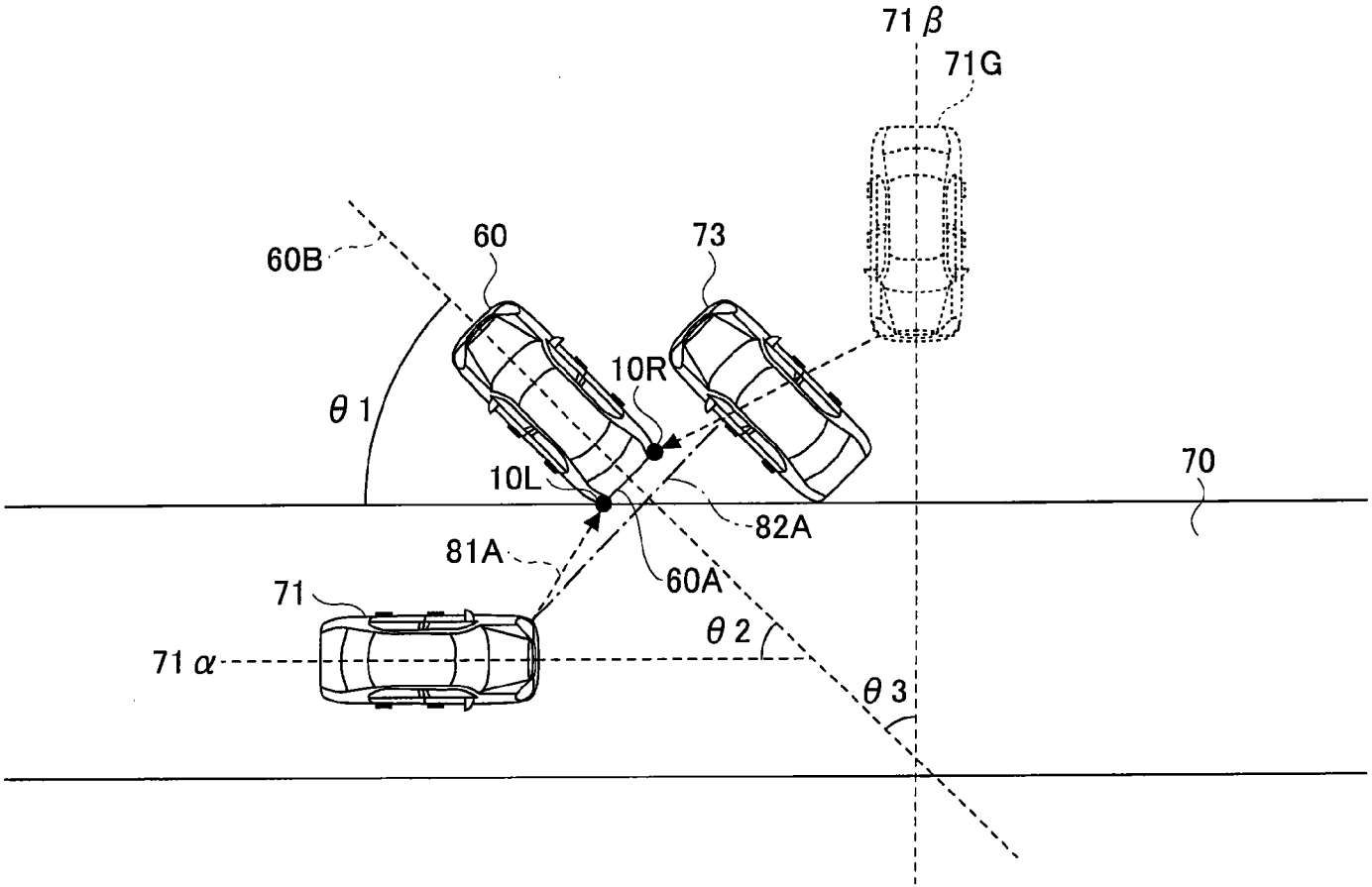
FIG. 8 is a diagram indicating a state where another vehicle 71 is approaching, which is travelling along the travelling lane 70 from the back left to the back right of the self-vehicle 60, when another vehicle 73 is parked in a parking space on the immediate right of the self-vehicle 60 in which the alarm device 100 according to the first embodiment is installed.

Furthermore, as indicated in FIG. 8, when the self-vehicle 60 is parked at an angle of 45° with respect to the travelling lane 70, and the another vehicle 73 is parked in a parking space on the immediate right of the self-vehicle 60, it is assumed that another vehicle 71 approaches, which is travelling along the travelling lane 70 from the back left to the back right of the self-vehicle 60.

In this case, a reflected wave 81A, which is caused as a radar emitted from the millimeter-wave radar device 10L is reflected from another vehicle 71, is received by the millimeter-wave radar device 10L, and a reflected wave 82A is received by the millimeter-wave radar device 10R. With respect to the path of the reflected wave 81A indicated by a dashed line, the path of the reflected wave 82A indicated by a dashed-dotted line is a multipath with respect to the path of the reflected wave 81A, which is the proper path.

Another vehicle 73 is parked substantially parallel to the self-vehicle 60, on the immediate right of the self-vehicle 60, and therefore another vehicle 71G that is a ghost appears to have a movement direction that is substantially symmetrical to the movement direction of another vehicle 71, across the center axis 60B of the self-'vehicle 60.

That is to say, when an angle θ1 formed by the travelling lane 70 and the center axis 60B of the self-vehicle 60 is 45°, an angle θ2, which is formed by a movement direction of another vehicle 71 travelling from the back left to the back right of the self-vehicle 60 along the travelling lane 70 and the center axis 60B of the self-vehicle 60, is approximately 45°.

In this case, another vehicle 71G that is a ghost is detected as having a movement direction forming an angle θ3 of approximately 45° with respect to the center axis 60B of the self-vehicle 60, on the opposite side of another vehicle 71 across the center axis 60B of the self-vehicle 60.

Note that the determination of whether the movement directions are substantially symmetrical across the center axis 60B of the self-vehicle 60 is made by determining whether an angle difference between an angle formed by the speed vector of a first another vehicle and the center axis 60B, and an angle formed by the speed vector of a second another vehicle and the center axis 60B, is less than or equal to a predetermined angle. The predetermined angle may be set to, for example, 10°.

As described above, the movement direction of another vehicle 71 and the movement direction of another vehicle 71G that is a ghost are substantially symmetrical across the center axis 60B of the self-vehicle 60. Therefore, by determining whether the movement directions of two another vehicles having different movement directions are substantially symmetrical across the center axis 60B of the self-vehicle 60, it is possible to determine whether the second another vehicle is a ghost, with even higher precision.

As described above, by the determining process of determining whether the movement directions of two another vehicles having different movement directions are substantially symmetrical across the center axis 60B of the self-vehicle 60, and the determining process of step S5 of determining whether the speed difference between the first relative speed of the first another vehicle and the self-vehicle and the second relative speed of the second another vehicle and the self-vehicle is less than or equal to a predetermined speed, it is possible to determine whether the speed vector of the first another vehicle and the speed vector of the second another vehicle are substantially symmetrical across the center axis 60B of the self-vehicle 60.

That is to say, when the speed difference between the relative speed of the first another vehicle and the relative speed of the second another vehicle is less than or equal to a predetermined speed, and when the angle difference between an angle of the movement direction of the first another vehicle with respect to the center axis 60B of the self-vehicle 60, and an angle of the movement direction of the second another vehicle with respect to the center axis 60B of the self-vehicle 60, is less than or equal to a predetermined angle, it is determined that the speed vector of the first another vehicle and the speed vector of the second another vehicle are substantially symmetrical across the center axis 60B of the self-vehicle 60.

Note that in the above description, another vehicle 73 is parked on the immediate right of the self-vehicle 60; however, the same applies to a case where there is a wall of a building, etc., instead of another vehicle 73, and the same applies to a state where another vehicle 73 is parked on the immediate left of the self-vehicle 60.

As described above, according to the first embodiment, in a state where there is another vehicle or a wall of a building, etc., next to the self-vehicle 60, when another vehicle is travelling in the left/right direction with respect to the self-vehicle 60 behind the self-vehicle 60, even when a reflected wave of radar is received according to a multipath, when the first another vehicle and the second another vehicle satisfy the above conditions, the second another vehicle is regarded as a ghost and the activation of an alarm is masked, and therefore behind the self-vehicle 60, it is possible to suppress erroneous detections and detect another vehicle with high precision.

Note that in the above, a description is made of a configuration where the second another vehicle is regarded as a ghost and an alarm is masked, when conditions of both steps S4, S5 are satisfied. However, for example, the alarm for the second another vehicle may be masked when only the condition of step S4 is satisfied, without performing the process of step S5.

That is to say, in a case where a second another vehicle is detected, which is approaching from the opposite side that is different from the movement direction of the first another vehicle, after a first another vehicle approaching from the back right or the back left of the self-vehicle 60 is detected, when the second distance is longer than the first distance, and the distance difference between the first distance and the second distance is less than or equal to a predetermined distance, the alarm for the second another vehicle may be masked.

In this case, erroneous detections can be suppressed and another vehicle can be detected, with a configuration in which the determination process is simplified.

Similarly, for example, the alarm for the second another vehicle may be masked when only the condition of step S5 is satisfied, without performing the process of step S4.

That is to say, in a case where a second another vehicle is detected, which is approaching from the opposite side that is different from the movement direction of the first another vehicle, after a first another vehicle approaching from the back right or the back left of the self-vehicle 60 is detected, when the speed difference between a relative speed of a first another vehicle and the self-vehicle and a relative speed of a second another vehicle and the self-vehicle is less than or equal to a predetermined speed, the alarm for the second another vehicle may be masked.

In this case, erroneous detections can be suppressed and another vehicle can be detected, with a configuration in which the determination process is simplified.

Furthermore, without performing the processes of steps S4 and S5, when the movement directions of two another vehicles having different movement directions are substantially symmetrical across the center axis 60B of the self-vehicle 60, the alarm for the second another vehicle may be masked.

That is to say, in a case where a second another vehicle is detected, which is approaching from the opposite side that is different from the movement direction of the first another vehicle, after a first another vehicle approaching from the back right or the back left of the self-vehicle 60 is detected, when the movement directions of two another vehicles having different movement directions are substantially symmetrical across the center axis 60B of the self-vehicle 60, the alarm for the second another vehicle may be masked.

In this case, erroneous detections can be suppressed and another vehicle can be detected, with a configuration in which the determination process is simplified.

Furthermore, instead of the determination process of step S5 in FIG. 7, a process of determining whether the movement directions of two another vehicles having different movement directions are substantially symmetrical across the center axis 60B of the self-vehicle 60 may be performed.

That is to say, in step S4, when it is determined that the second distance is longer than the first distance, and the distance difference between the first distance and the second distance is less than or equal to a predetermined distance, and the movement directions of two another vehicles having different movement directions are substantially symmetrical across the center axis 60B of the self-vehicle 60, the alarm for the second another vehicle may be masked.

In this case, erroneous detections can be suppressed and another vehicle can be detected, with a configuration in which the determination process is simplified.

Furthermore, without performing the determination process of step S4, the determination process of step S5, and the process of determining whether the movement directions of two another vehicles having different movement directions are substantially symmetrical across the center axis 60B of the self-vehicle 60 may be performed.

That is to say, after detecting the second another vehicle in step S3, in a case where, in step S5, it is determined that the speed difference between the relative speed of the first another vehicle and the relative speed of the second another vehicle is less than or equal to a predetermined speed, and the movement directions of two another vehicles having different movement directions are substantially symmetrical across the center axis 60B of the self-vehicle 60, the alarm for the second another vehicle may be masked.

In this case, erroneous detections can be suppressed and another vehicle can be detected, with a configuration in which the determination process is simplified.

Furthermore, in the above, a description is given of a configuration in which when the second distance is longer than the first distance, and the distance difference between the first distance and the second distance is less than or equal to a predetermined distance, the alarm for the second another vehicle is masked. However, when the signal level of a reflected wave received from the first another vehicle is higher than the signal level (voltage) of a reflected wave received from the second another vehicle, and the distance difference between the first distance and the second distance is less than or equal to a predetermined distance, the alarm for the second another vehicle may be masked.

When the first another vehicle is closer to the self-vehicle 60 than the second another vehicle, the signal level of the reflected wave received from the first another vehicle is higher than the signal level of the reflected wave received from the second another vehicle. Therefore, instead of determining whether the second distance is longer than the first distance, it may be determined whether the signal level of the reflected wave received from the first another vehicle is higher than the signal level of the reflected wave received from the second another vehicle.

Note that in the above, a description is given of a configuration of notifying an alarm from the speaker 40, the buzzer 41, the indicator 42, and the display device 43; however, the activation of the alarm may be performed by at least one of the speaker 40, the buzzer 41, the indicator 42, and the display device 43.

Second Embodiment

An alarm device according to a second embodiment masks the activation of an alarm with respect to a second another vehicle, in a case where two another vehicles having different movement directions are detected behind the self-vehicle 60, and the time difference between a first estimated crossing time (ECT) of the self-vehicle 60 and the first another vehicle and a second estimated crossing time of the self-vehicle 60 and the second another vehicle is less than or equal to a predetermined time.

That is to say, in the alarm device according to the second embodiment, during a predetermined time after an alarm has been activated for a first another vehicle, the activation of an alarm for a second another vehicle is masked.

In the alarm device according to the second embodiment, the configuration of ECUs 230R, 230L included in the millimeter-wave radar devices 10R, 10L is different from that of the ECU 30R included in the millimeter-wave radar device 10R of the alarm device 100 according to the first embodiment. Other configurations are the same as those of the alarm device 100 according to the first embodiment, and therefore the same elements are denoted by the same reference numerals, and descriptions thereof are omitted.

Figure 9A:
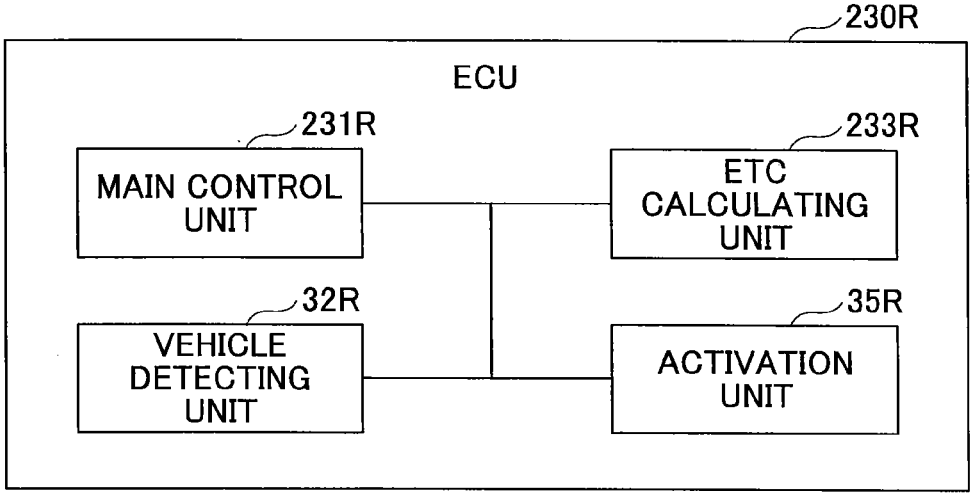
FIG. 9A is a diagram indicating functional blocks included in the ECU 230R of the alarm device according to a second embodiment.
Figure 9B:
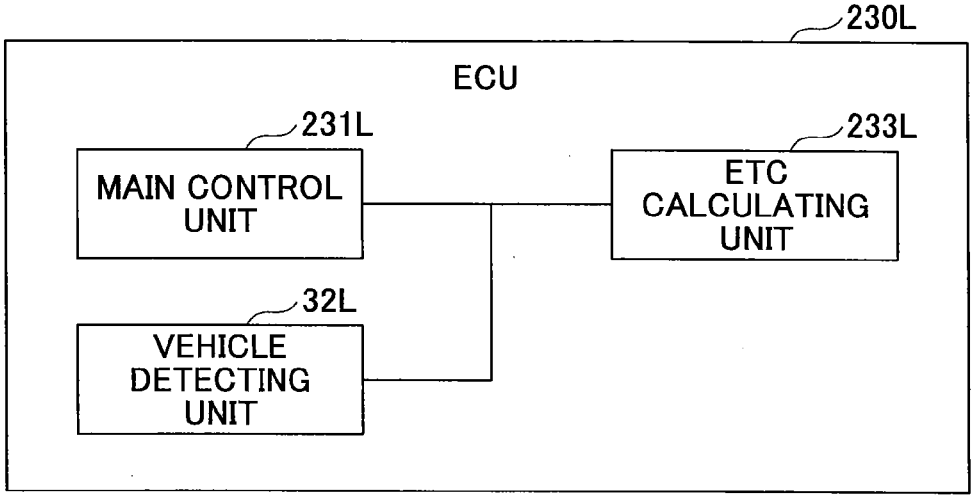
FIG. 9B is a diagram indicating functional blocks included in the ECU 230L of the alarm device according to the second embodiment.
Figure 10:
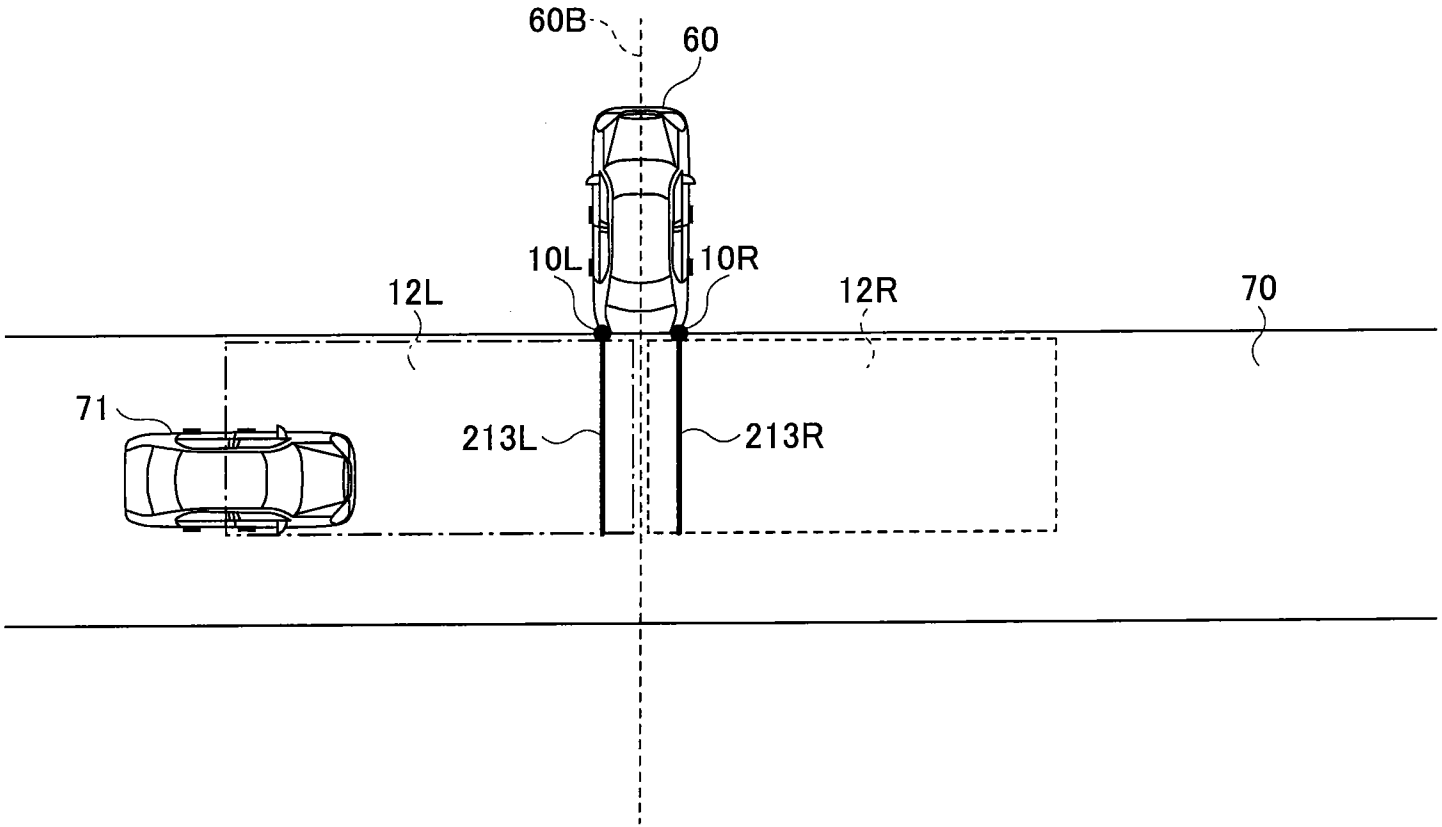
FIG. 10 is a diagram indicating an alarm line used for calculating the estimated crossing time.

FIG. 9A is a diagram indicating functional blocks included in the ECU 230R of the alarm device according to the second embodiment. FIG. 9B is a diagram indicating functional blocks included in the ECU 230L of the alarm device according to the second embodiment. FIG. 10 is a diagram indicating an alarm line used for calculating the estimated crossing time.

The ECU 230R includes a main control unit 231R, the vehicle detecting unit 32R, an ETC calculating unit 233R, and the alarm activation unit 35R. The ECU 230L includes a main control unit 231L, the vehicle detecting unit 32L, and an ETC calculating unit 233L.

The ETC calculating unit 233R calculates the time until the trajectory of the self-vehicle 60 and the trajectory of another vehicle cross, based on signals input from the radar unit 20R, in a case where the self-vehicle 60 reverses and another vehicle moves in the movement direction.

The ETC calculating unit 233R calculates, as the estimated crossing time (ECT), the required time until an alarm line 213R virtually extending behind the self-vehicle 60 and another vehicle 71 in the detection region 12R cross, as indicated in FIG. 10.

The estimated crossing time (ECT) is obtained by dividing the distance between another vehicle 71 and the alarm line 213R by the relative speed of another vehicle 71 and the self-vehicle 60.

The ETC calculating unit 233L calculates the time until the trajectory of the self-vehicle 60 and the trajectory of another vehicle cross, based on signals input from the radar unit 20L, in a case where the self-vehicle 60 reverses and another vehicle moves in the movement direction.

The ETC calculating unit 233L calculates, as the estimated crossing time (ECT), the required time until an alarm line 213L virtually extending behind the self-vehicle 60 and another vehicle in the detection region 12L cross, as indicated in FIG. 10.

The estimated crossing time (ECT) is obtained by dividing the distance between another vehicle and the alarm line 213L by the relative speed of another vehicle and the self-vehicle 60.

The estimated crossing time calculated by the ETC calculating unit 233L is transmitted to the main control unit 231R.

Figure 11:
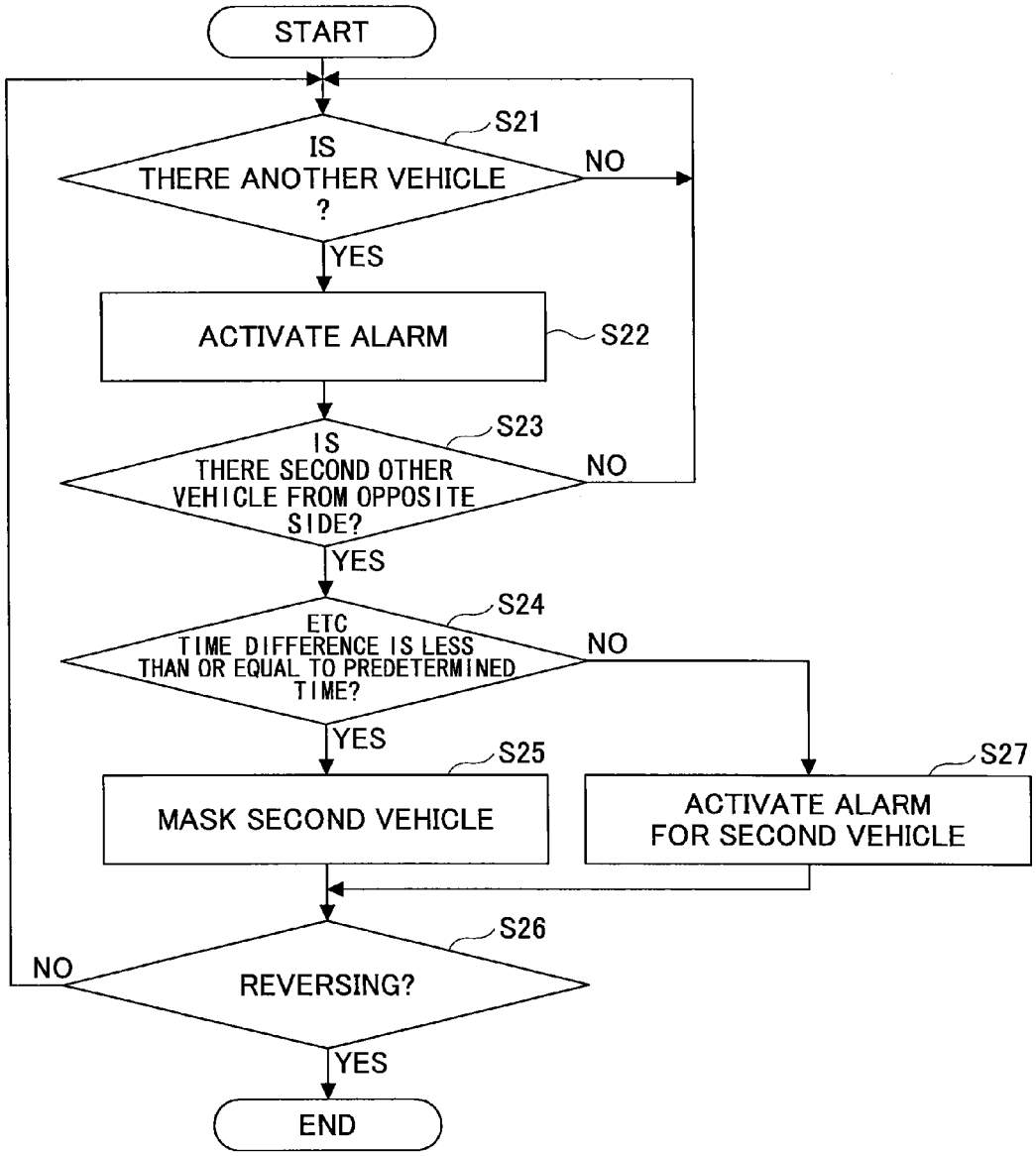
FIG. 11 is a flowchart indicating a process executed by the ECU 230R of the alarm device according to the second embodiment.

FIG. 11 is a flowchart indicating a process executed by the ECU 230R of the alarm device according to the second embodiment. The process of this flowchart is a process executed by the main control unit 231R of the ECU 230R of the alarm device according to the second embodiment.

When the self-vehicle 60 starts reversing from the parked state, the main control unit 231R starts the process (START). As the signal input from the shift position sensor 54 indicates "R" (reverse), the main control unit 231R recognizes that the self-vehicle 60 has started to reverse from the parked state.

The main control unit 231R determines whether another vehicle is detected (step S21). The detection of another vehicle is to be performed based on whether a detection signal is received from the radar unit 20R or 20L.

When the main control unit 231R determines that another vehicle is detected (step S21: YES), the main control unit 231R transmits an activation instruction to the activation unit 35R (step S22). As a result, the activation unit 35R causes the speaker 40, the buzzer 41, the indicator 42, and the display device 43 to activate an alarm.

Next, the main control unit 231R determines whether a second another vehicle is detected from the other one of the millimeter-wave radar devices 10R, 10L (step S23). That is to say, in step S23, the main control unit 231R determines whether a second another vehicle is detected, by the millimeter-wave radar device (10R or 10L) on the opposite (left or right) side to another vehicle detected in step S21.

This is because, after the first another vehicle approaching from the back right side or the back left side of the self-vehicle 60 is detected, when a second another vehicle approaching from the opposite side that is a different movement direction to that of the first another vehicle is detected, there is a possibility that a ghost is erroneously detected as a second another vehicle.

When the main control unit 231R determines that a second another vehicle is detected (step S23: YES), the main control unit 231R determines whether the second estimated crossing time of the self-vehicle 60 and the second another vehicle is longer than the first estimated crossing time of the self-vehicle 60 and the first another vehicle, and the time difference between the first estimated crossing time and the second estimated crossing time is less than or equal to a predetermined time (step S24).

The first estimated crossing time is detected by the ETC calculating unit (either 233R or 233L) of the millimeter-wave radar device (either 10R or 10L) that detected the first another vehicle. The second estimated crossing time is detected by the ETC calculating unit (either 233R or 233L) of the millimeter-wave radar device (either 10R or 10L) that detected the second another vehicle.

The main control unit 231R compares the first estimated crossing time and the second estimated crossing time, to determine whether the second estimated crossing time is longer than the first estimated crossing time, and the time difference between the first estimated crossing time and the second estimated crossing time is less than or equal to a predetermined time. Note that the predetermined time is, for example, two seconds.

When the main control unit 231R determines that the second estimated crossing time is longer than the first estimated crossing time, and the time difference between the first estimated crossing time and the second estimated crossing time is less than or equal to a predetermined time (step S24: YES), the main control unit 231R masks the activation of an alarm with respect to the vehicle detected as the second another vehicle (step S25).

Accordingly, the activation of an alarm with respect to the vehicle detected as a second another vehicle is masked. This is because the second another vehicle is determined to be a ghost.

Next, the main control unit 231R determines whether the self-vehicle 60 is reversing (step S26). When the self-vehicle 60 is reversing, other vehicles need to be continuously detected, and when the self-vehicle 60 is not reversing, other vehicles do not need to be continuously detected, and therefore it is determined whether the self-vehicle 60 is reversing.

When the main control unit 231R determines that the self-vehicle 60 is reversing (step S26: YES), the main control unit 231R returns to step S23 in the flow, and the main control unit 231R executes the process of step S23. Furthermore, when the main control unit 231R determines that the self-vehicle 60 is not reversing (step S26: NO), the series of processes is ended. This is because, for example, when the self-vehicle 60 starts moving forward, there is no need to monitor another vehicle behind the self-vehicle 60.

Note that in step S23, when the main control unit 231R determines that a second another vehicle is not detected, the main control unit 231R returns to step S21 in the flow. In this case, there is no possibility that a ghost is erroneously detected, and therefore the main control unit 231R returns to step S21 in the flow.

Furthermore, in step S24, when the main control unit 231R determines that a second estimated crossing time is longer than the first estimated crossing time, and the time difference between the first estimated crossing time and the second estimated crossing time is not less than or equal to a predetermined time, the main control unit 231R proceeds to step S27 in the flow.

The main control unit 31R transmits an activation instruction to the activation unit 35R, to activate an alarm with respect to the second another vehicle (step S27). As a result, the activation unit 35R causes the speaker 40, the buzzer 41, the indicator 42, and the display device 43 to activate an alarm. This alarm is an alarm with respect to the second another vehicle.

When the second estimated crossing time is not longer than the first estimated crossing time, and when the time difference between the first estimated crossing time and the second estimated crossing time is not less than or equal to the predetermined time, there is a high possibility that the second another vehicle is not a ghost, and therefore an alarm is also activated for the second another vehicle.

Note that when the process of step S27 ends, the main control unit 231R proceeds to step S26 in the flow.

According to the above, the series of processes for masking the activation of an alarm with respect to another vehicle that is a ghost is ended.

Note that in the above, a description is given of a configuration in which after determining there is a second another vehicle in step S23, in step S24, it is determined whether the second estimated crossing time of the self-vehicle 60 and the second another vehicle is longer than the first estimated crossing time of the self-vehicle 60 and the first another vehicle, and the time difference between the first estimated crossing time and the second estimated crossing time is less than or equal to a predetermined time.

However, the process of step S24 may be, for example, inserted in the flow of the first embodiment indicated in FIG. 7. For example, step S24 may be inserted between step S3 and step S4, between step S4 and step S5, or between step S5 and step S6.

Furthermore, in this case, step S24 may be inserted in the flow of FIG. 7 upon omitting step S4 or step S5.

Furthermore, instead of steps S4 and step S5 of FIG. 7, a process of determining whether the movement directions of two another vehicles having different movement directions are substantially symmetrical across the center axis 60B of the self-vehicle 60, and the process of step S24 may be performed. Furthermore, step S4 or step S5 may be added to the process of determining whether the movement directions of two another vehicles having different movement directions are substantially symmetrical across the center axis 60B of the self-vehicle 60, and the process of step S24.

As described above, according to the second embodiment, in a state where there is another vehicle or a wall of a building, etc., next to the self-vehicle 60, when another vehicle is travelling in the left/right direction with respect to the self-vehicle 60 behind the self-vehicle 60, even when a reflected wave of radar is received according to a multipath, when the first another vehicle and the second another vehicle satisfy the above conditions, the second another vehicle is regarded as a ghost and the activation of an alarm is masked, and therefore behind the self-vehicle 60, it is possible to suppress erroneous detections and detect another vehicle with high precision.

Furthermore, with the alarm device according to the second embodiment, only the data expressing the estimated crossing time calculated by the ETC calculating unit 233L in the ECU 230L of the millimeter-wave radar device 10L needs to be transmitted to the ETC calculating unit 233R in the ECU 230R of the millimeter-wave radar device 10R, and therefore the program for realizing the process indicated in FIG. 11 can be simplified. This is because there is no need to transmit information expressing speed and distance from the millimeter-wave radar device 10L to the millimeter-wave radar device 10R as in the first embodiment, and the processing amount in the ECU 230R can be reduced.

Note that in the above, a description is given of a configuration of masking the activation of an alarm with respect to a second another vehicle, in a case where two another vehicles having different movement directions are detected behind the self-vehicle 60, and the time difference between a first estimated crossing time of the self-vehicle 60 and the first another vehicle and a second estimated crossing time of the self-vehicle 60 and the second another vehicle is less than or equal to a predetermined time.

However, for the purpose of simplifying the control of the alarm device according to the second embodiment, it may not be determined that the movement direction of the second another vehicle is different from the movement direction of the first another vehicle. That is to say, when the time difference between a first estimated crossing time of the self-vehicle 60 and the first another vehicle and a second estimated crossing time of the self-vehicle 60 and the second another vehicle is less than or equal to a predetermined time, the activation of an alarm with respect to the second another vehicle may be masked, without determining the movement direction of the second another vehicle.

In the above, a description is given of an alarm device according to an exemplary embodiment of the present invention; however, the present invention is not limited to the specific embodiments disclosed herein, and various modifications and changes may be made without departing from the scope of the present invention.

DESCRIPTION OF REFERENCE SYMBOLS

100 alarm device
10R, 10L millimeter-wave radar device
11R, 11L detection possible region
12R, 12L detection region
20R radar unit
20L radar unit
30R, 30L ECU
31R, 31L main control unit
32R, 32L vehicle detecting unit
33R, 33L distance calculating unit
34R, 34L speed calculating unit
35R activation unit
40 speaker
41 buzzer
42 indicator
43 display device
50 ignition switch
52 vehicle speed sensor
54 shift position sensor
56 accelerator opening sensor
60 self-vehicle
60A back end part
60B center axis
70 travelling lane
71, 71G, 72, 73 another vehicle
230R, 230L ECU
231R, 231L main control unit
233R, 233L ETC calculating unit

The invention claimed is:

1. An alarm device comprising:

a first detection unit configured to detect another vehicle approaching from the back right of a self-vehicle;

a second detection unit configured to detect another vehicle approaching from the back left of the self-vehicle;

an alarm unit configured to activate an alarm for notifying that another vehicle is approaching to a driver of the self-vehicle; and a control unit configured to cause the alarm unit to activate the alarm when the first detection unit or the second detection unit detects another vehicle, wherein the control unit suppresses the activation of the alarm for a second another vehicle when the self-vehicle is reversing from a parked state, in a case where after one of the first detection unit or the second detection unit detects a first another vehicle, another one of the first detection unit or the second detection unit detects the second another vehicle, in a case where a distance difference between a first distance between the first another vehicle and the self-vehicle and a second distance between the second another vehicle and the self-vehicle is less than or equal to a predetermined distance, in a case where a speed difference between a first speed of the first another vehicle and a second speed of the second another vehicle is less than or equal to a predetermined speed, or in a case where a time difference between a first estimated crossing time of the first another vehicle and the self-vehicle and a second estimated crossing time of the second another vehicle and the self-vehicle is less than or equal to a predetermined time.

2. The alarm device according to claim 1, wherein the control unit suppresses the activation of the alarm for the second another vehicle in a case where the second distance is longer than the first distance, and in a case where the distance difference between the first distance and the second distance is less than or equal to the predetermined distance.

3. The alarm device according to claim 1, wherein the control unit suppresses the activation of the alarm for the second another vehicle in a case where a signal level of a reflected wave from the first another vehicle is higher than a signal level of a reflected wave from the second another vehicle.

4. The alarm device according to claim 1, wherein the control unit suppresses the activation of the alarm for the second another vehicle in a case where the second estimated crossing time is longer than the first estimated crossing time, and in a case where the time difference between the first estimated crossing time and the second estimated crossing time is less than or equal to the predetermined time.

5. The alarm device according to claim 1, wherein the control unit further suppresses the activation of the alarm for the second another vehicle in a case where a first speed vector of the first another vehicle and a second speed vector of the second another vehicle are substantially axisymmetrical across a center axis of the self-vehicle.

* * * * *